US010727557B2

(12) United States Patent
Ashida et al.

(10) Patent No.: US 10,727,557 B2
(45) Date of Patent: Jul. 28, 2020

(54) DIELECTRIC RESONATOR AND DIELECTRIC FILTER

(71) Applicant: TDK CORPORATION, Tokyo (JP)

(72) Inventors: Yuta Ashida, Tokyo (JP); Shigemitsu Tomaki, Tokyo (JP); Yousuke Futamata, Tokyo (JP); Shin Takane, Tokyo (JP); Yasuharu Miyauchi, Tokyo (JP); Kazunari Kimura, Tokyo (JP)

(73) Assignee: TDK CORPORATION, Tokyo (JP)

( * ) Notice: Subject to any disclaimer, the term of this patent is extended or adjusted under 35 U.S.C. 154(b) by 33 days.

(21) Appl. No.: 16/227,558

(22) Filed: Dec. 20, 2018

(65) Prior Publication Data

US 2019/0252753 A1 Aug. 15, 2019

(30) Foreign Application Priority Data

Feb. 9, 2018 (JP) ..... 2018-021844

(51) Int. Cl.

| | |
|---|---|
| ***H01P 7/10*** | (2006.01) |
| ***H01P 1/30*** | (2006.01) |
| ***H01P 11/00*** | (2006.01) |
| ***H01P 1/20*** | (2006.01) |
| ***H01P 1/208*** | (2006.01) |

(52) U.S. Cl.

CPC ..... *H01P 1/30* (2013.01); *H01P 1/2002* (2013.01); *H01P 1/2084* (2013.01); *H01P 7/10* (2013.01); *H01P 11/007* (2013.01); *H01P 11/008* (2013.01)

(58) Field of Classification Search

CPC ..... H01P 1/2084; H01P 1/208; H01P 7/06; H01P 7/065; H01P 7/10

USPC ..... 333/208, 209, 202, 219.1

See application file for complete search history.

(56) References Cited

U.S. PATENT DOCUMENTS

2013/0293320 A1 11/2013 Komatsu et al.

FOREIGN PATENT DOCUMENTS

| | | |
|---|---|---|
| JP | 2005-200269 A | 7/2005 |
| JP | 2006-238027 A | 9/2006 |

*Primary Examiner* — Stephen E. Jones
(74) *Attorney, Agent, or Firm* — Oliff PLC

(57) ABSTRACT

A dielectric filter includes a plurality of dielectric resonators. The dielectric filter also includes: a plurality of resonator body portions each formed of a first dielectric and respectively corresponding to the plurality of dielectric resonators, the first dielectric having a first relative permittivity; a peripheral dielectric portion formed of a second dielectric and lying around the plurality of resonator body portions, the second dielectric having a second relative permittivity lower than the first relative permittivity; and a shield portion formed of a conductor. Either one of a temperature coefficient of resonant frequency of the first dielectric at 25° C. to 85° C. and a temperature coefficient of resonant frequency of the second dielectric at 25° C. to 85° C. has a positive value and the other has a negative value.

14 Claims, 10 Drawing Sheets

DIELECTRIC RESONATOR AND DIELECTRIC FILTER

BACKGROUND OF THE INVENTION

1. Field of the Invention

The present invention relates to a dielectric resonator, and a dielectric filter including a plurality of dielectric resonators.

2. Description of the Related Art

The standardization of fifth-generation mobile communication systems (hereinafter referred to as 5G) is currently ongoing. For 5G, the use of frequency bands of 10 GHz or higher, particularly a quasi-millimeter wave band of 10 to 30 GHz and a millimeter wave band of 30 to 300 GHz, is being studied to expand the frequency band.

Among electronic components for use in communication apparatuses are band-pass filters each including a plurality of resonators. Dielectric filters each including a plurality of dielectric resonators are promising as band-pass filters usable in the frequency bands of 10 GHz or higher.

A dielectric resonator typically includes a resonator body portion formed of a dielectric, a peripheral dielectric portion lying around the resonator body portion, and a shield portion. The peripheral dielectric portion is formed of a dielectric having a relative permittivity lower than that of the dielectric forming the resonator body portion. The shield portion lies around the resonator body portion such that at least part of the peripheral dielectric portion is interposed between the resonator body portion and the shield portion. The shield portion has a function of confining an electromagnetic field.

JP2006-238027A describes a dielectric filter including a dielectric substrate, a plurality of dielectric resonators embedded in the dielectric substrate, and an outer conductor film. The outer conductor film covers part of an outer surface of the dielectric substrate. Each of the plurality of dielectric resonators in JP2006-238027A corresponds to the resonator body portion mentioned above. The dielectric substrate and the outer conductor film in JP2006-238027A respectively correspond to the peripheral dielectric portion and the shield portion mentioned above.

One of the performances desired of dielectric resonators is a small change in resonant frequency in response to a change in temperature, that is, a low temperature coefficient of resonant frequency.

US2013/0293320A1 and JP2005-200269A each describe a dielectric material that is used to form a resonator body portion and has a low temperature coefficient of resonant frequency in terms of absolute value. It should be noted that the temperature coefficient of resonant frequency disclosed in each of US2013/0293320A1 and JP2005-200269A is that of a dielectric material, not that of a dielectric resonator.

Each of US2013/0293320A1 and JP2005-200269A also describes a dielectric resonator or dielectric filter with a resonator body portion provided in a metal case wherein the space between the metal case and the resonator body portion is filled with air. The dielectric material described in each of US2013/0293320A1 and JP2005-200269A is suited to form the resonator body portion of the dielectric resonator or dielectric filter having such a configuration.

However, the dielectric resonator in which the peripheral dielectric portion around the resonator body portion is formed of a dielectric material other than air has a problem that the temperature coefficient of resonant frequency of the dielectric resonator cannot necessarily be reduced in absolute value by simply reducing the absolute value of the temperature coefficient of resonant frequency of the dielectric material forming the resonator body portion.

SUMMARY OF THE INVENTION

It is an object of the present invention to provide a dielectric resonator and a dielectric filter configured to reduce the temperature coefficient of resonant frequency of the dielectric resonator in absolute value.

A dielectric resonator of a first aspect of the present invention includes: a resonator body portion formed of a first dielectric having a first relative permittivity; a peripheral dielectric portion formed of a second dielectric and lying around the resonator body portion, the second dielectric having a second relative permittivity lower than the first relative permittivity; and a shield portion formed of a conductor. The shield portion lies around the resonator body portion such that at least part of the peripheral dielectric portion is interposed between the shield portion and the resonator body portion. Either one of a temperature coefficient of resonant frequency of the first dielectric at 25° C. to 85° C. and a temperature coefficient of resonant frequency of the second dielectric at 25° C. to 85° C. has a positive value and the other has a negative value.

In the dielectric resonator of the first aspect of the invention, a temperature coefficient of resonant frequency of the dielectric resonator at 25° C. to 85° C. may be lower in absolute value than the temperature coefficient of resonant frequency of the first dielectric at 25° C. to 85° C. and the temperature coefficient of resonant frequency of the second dielectric at 25° C. to 85° C.

In the dielectric resonator of the first aspect of the invention, the temperature coefficient of resonant frequency of the dielectric resonator at 25° C. to 85° C. may be 33 ppm/° C. or less in absolute value, or may be 10 ppm/° C. or less in absolute value.

In the dielectric resonator of the first aspect of the invention, the resonator body portion may be in non-contact with the shield portion.

A dielectric filter of the first aspect of the invention includes a plurality of dielectric resonators. The dielectric filter of the first aspect of the invention further includes: a plurality of resonator body portions each formed of a first dielectric and respectively corresponding to the plurality of dielectric resonators, the first dielectric having a first relative permittivity; a peripheral dielectric portion formed of a second dielectric and lying around the plurality of resonator body portions, the second dielectric having a second relative permittivity lower than the first relative permittivity; and a shield portion formed of a conductor. The shield portion lies around the plurality of resonator body portions such that at least part of the peripheral dielectric portion is interposed between the shield portion and the plurality of resonator body portions. Each of the plurality of dielectric resonators is composed of a corresponding one of the plurality of resonator body portions, at least part of the peripheral dielectric portion, and the shield portion. Either one of a temperature coefficient of resonant frequency of the first dielectric at 25° C. to 85° C. and a temperature coefficient of resonant frequency of the second dielectric at 25° C. to 85° C. has a positive value and the other has a negative value.

In the dielectric filter of the first aspect of the invention, each of the plurality of resonator body portions may be in non-contact with the shield portion.

A dielectric resonator of a second aspect of the present invention includes: a resonator body portion formed of a first dielectric having a first relative permittivity; a peripheral dielectric portion formed of a second dielectric and lying around the resonator body portion, the second dielectric having a second relative permittivity lower than the first relative permittivity and higher than 1; and a shield portion formed of a conductor. The shield portion lies around the resonator body portion such that at least part of the peripheral dielectric portion is interposed between the shield portion and the resonator body portion. Both of a temperature coefficient of resonant frequency of the first dielectric at 25° C. to 85° C. and a temperature coefficient of resonant frequency of the second dielectric at 25° C. to 85° C. are 33 ppm/° C. or less in absolute value.

In the dielectric resonator of the second aspect of the invention, a temperature coefficient of resonant frequency of the dielectric resonator at 25° C. to 85° C. may be 33 ppm/° C. or less in absolute value.

In the dielectric resonator of the second aspect of the invention, both of the temperature coefficient of resonant frequency of the first dielectric at 25° C. to 85° C. and the temperature coefficient of resonant frequency of the second dielectric at 25° C. to 85° C. may be 10 ppm/° C. or less in absolute value. In such a case, the temperature coefficient of resonant frequency of the dielectric resonator at 25° C. to 85° C. may be 10 ppm/° C. or less in absolute value.

In the dielectric resonator of the second aspect of the invention, the resonator body portion may be in non-contact with the shield portion.

A dielectric filter of the second aspect of the invention includes a plurality of dielectric resonators. The dielectric filter of the second aspect of the invention further includes: a plurality of resonator body portions each formed of a first dielectric and respectively corresponding to the plurality of dielectric resonators, the first dielectric having a first relative permittivity; a peripheral dielectric portion formed of a second dielectric and lying around the plurality of resonator body portions, the second dielectric having a second relative permittivity lower than the first relative permittivity and higher than 1; and a shield portion formed of a conductor. The shield portion lies around the plurality of resonator body portions such that at least part of the peripheral dielectric portion is interposed between the shield portion and the plurality of resonator body portions. Each of the plurality of dielectric resonators is composed of a corresponding one of the plurality of resonator body portions, at least part of the peripheral dielectric portion, and the shield portion. Both of a temperature coefficient of resonant frequency of the first dielectric at 25° C. to 85° C. and a temperature coefficient of resonant frequency of the second dielectric at 25° C. to 85° C. are 33 ppm/° C. or less in absolute value.

In the dielectric filter of the second aspect of the invention, each of the plurality of resonator body portions may be in non-contact with the shield portion.

According to the dielectric resonators and dielectric filters of the first and second aspects of the invention, the temperature coefficient of resonant frequency of each of the first and second dielectrics satisfies the predetermined requirements. This enables reduction of the temperature coefficient of resonant frequency of the dielectric resonator in absolute value.

Other and further objects, features and advantages of the invention will appear more fully from the following description.

DETAILED DESCRIPTION OF THE PREFERRED EMBODIMENTS

First Embodiment

Figure 1:
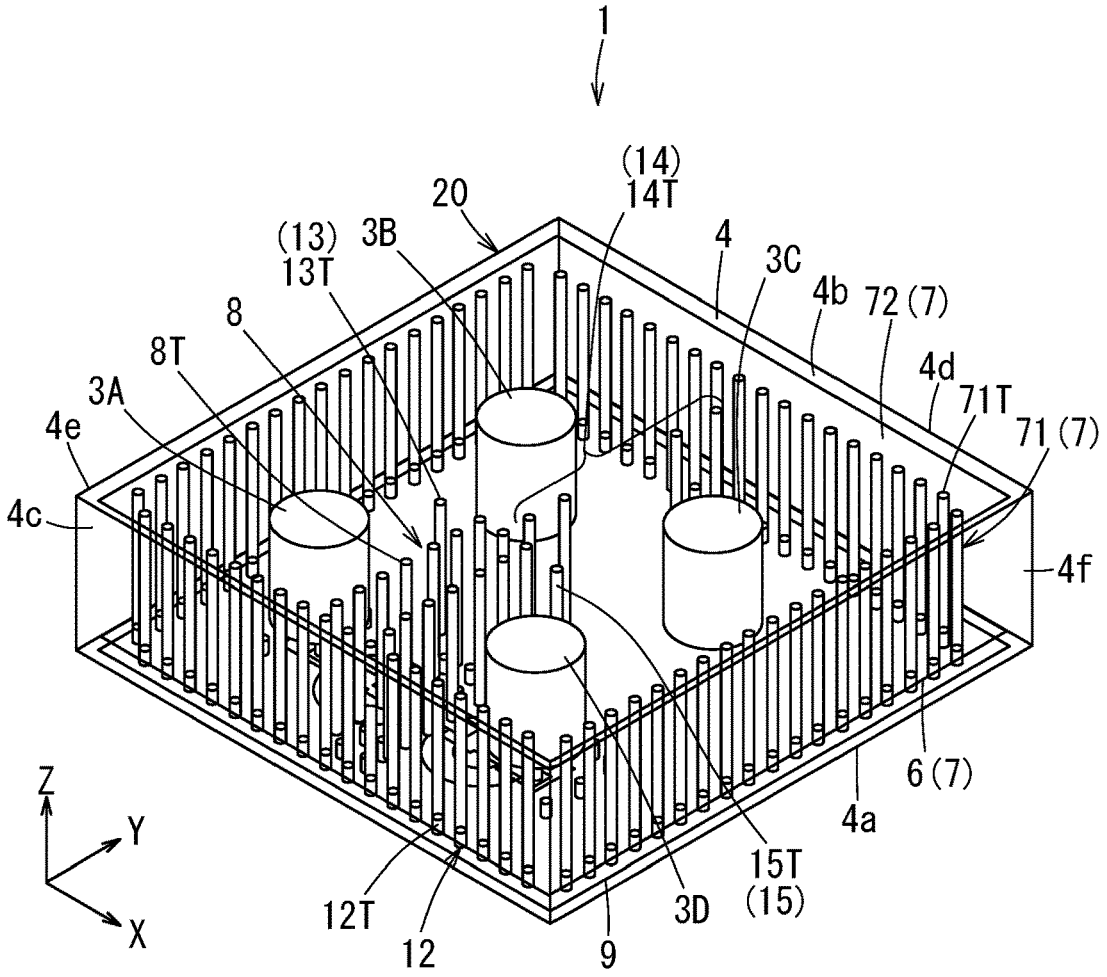
FIG. 1 is a perspective view illustrating the interior of a dielectric filter according to a first embodiment of the invention.
Figure 2:
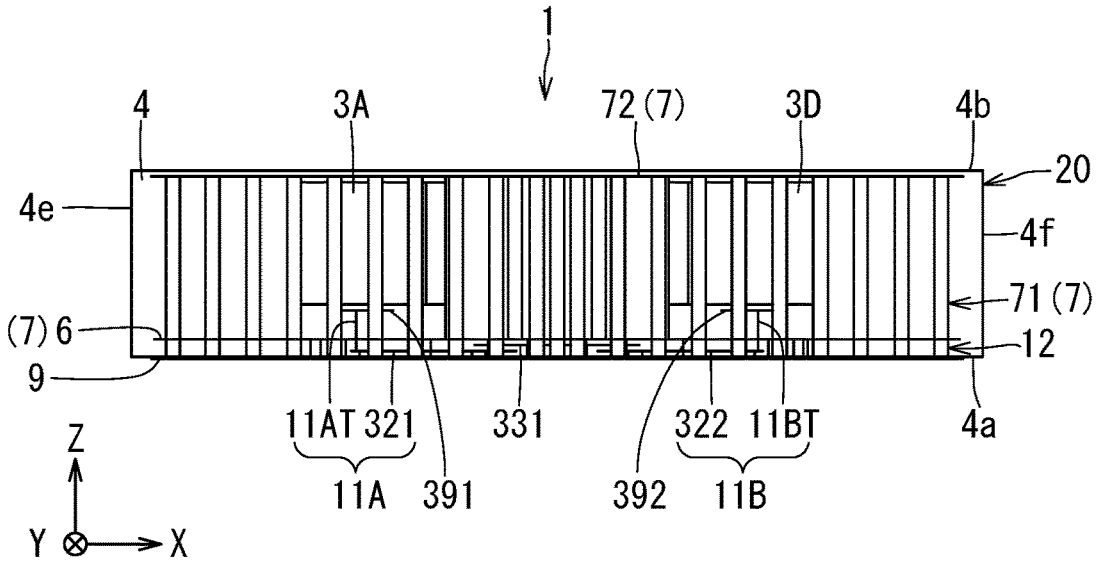
FIG. 2 is a side view illustrating the interior of the dielectric filter according to the first embodiment of the invention.
Figure 3:
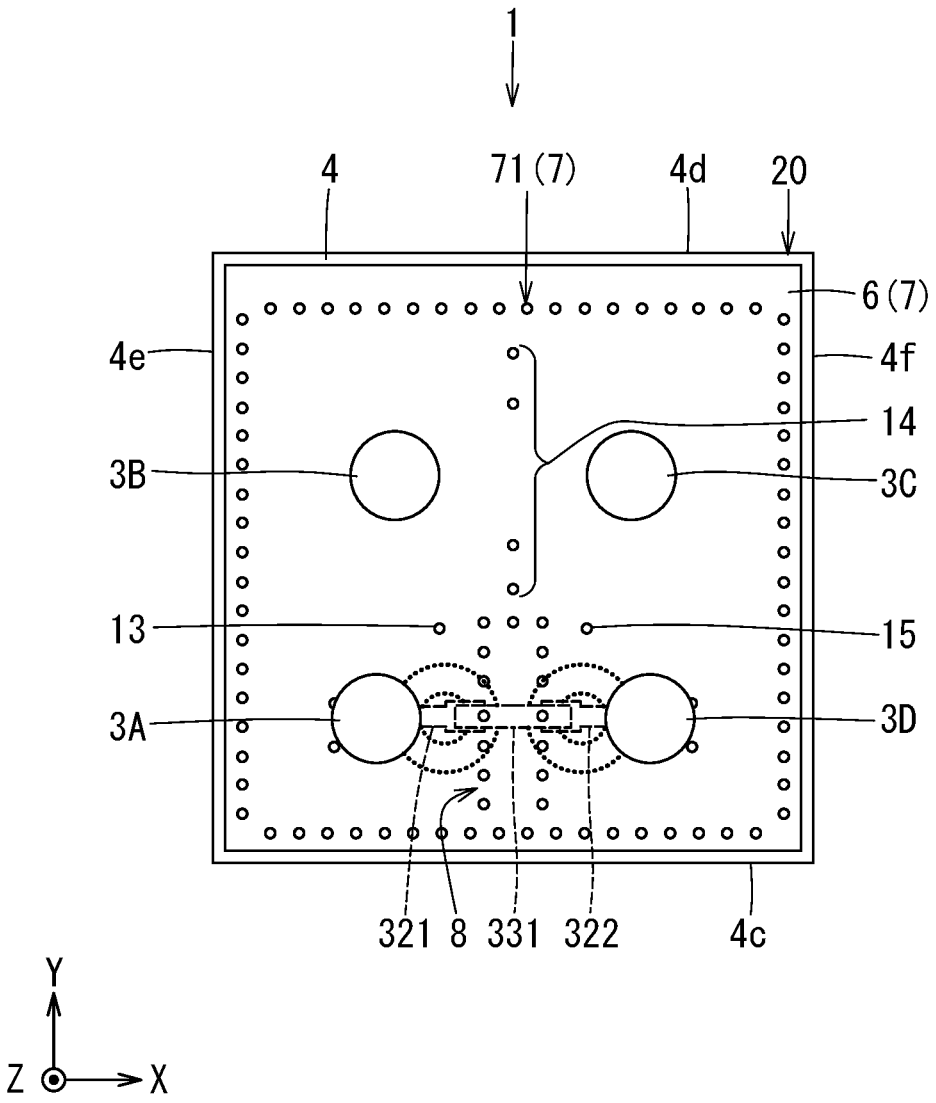
FIG. 3 is a plan view illustrating the interior of the dielectric filter according to the first embodiment of the invention.
Figure 4:
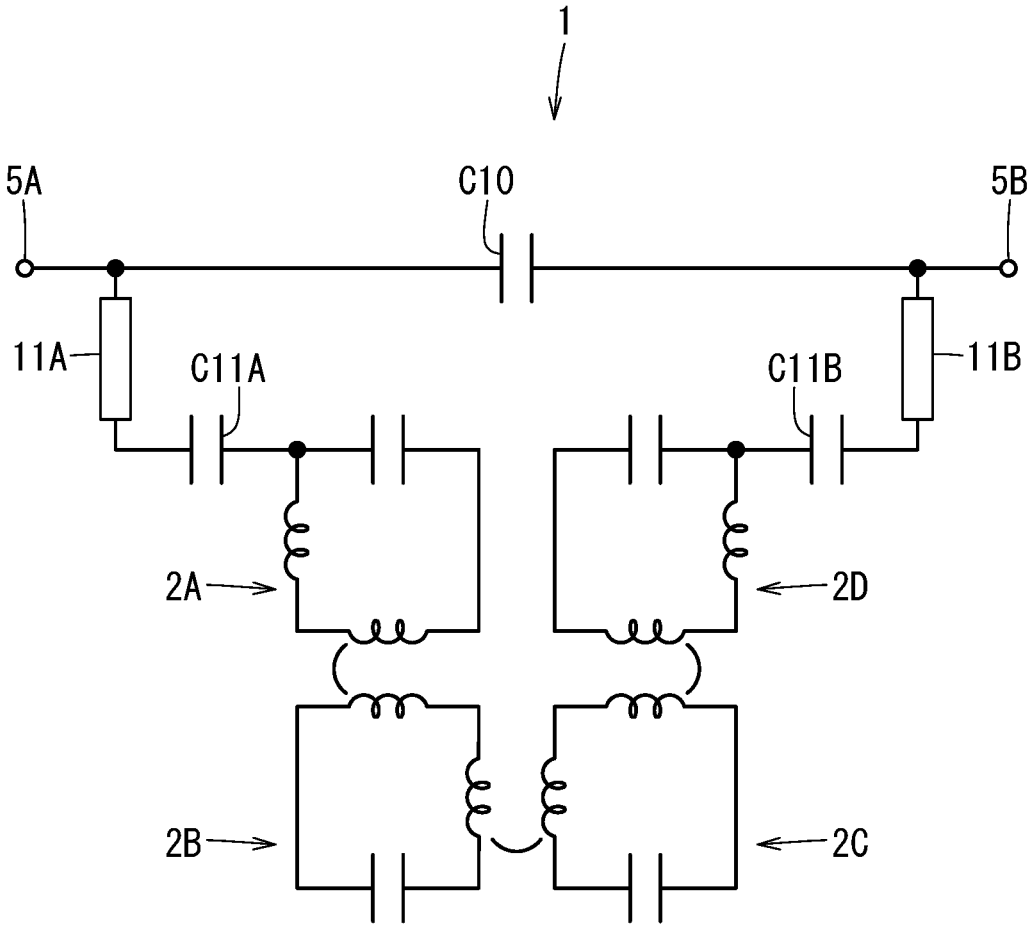
FIG. 4 is a circuit diagram illustrating an equivalent circuit of the dielectric filter according to the first embodiment of the invention.

Preferred embodiments of the present invention will now be described in detail with reference to the drawings. First, reference is made to FIG. 1 to FIG. 4 to describe the configuration of a dielectric filter according to a first embodiment of the invention. FIG. 1 is a perspective view illustrating the interior of the dielectric filter according to the present embodiment. FIG. 2 is a side view illustrating the interior of the dielectric filter according to the present embodiment. FIG. 3 is a plan view illustrating the interior of the dielectric filter according to the present embodiment. FIG. 4 is a circuit diagram illustrating an equivalent circuit of the dielectric filter according to the present embodiment.

The dielectric filter 1 according to the present embodiment has a band-pass filter function. As shown in FIG. 4, the dielectric filter 1 includes a first input/output port 5A, a second input/output port 5B, a plurality of dielectric resonators, and a capacitor C10 for capacitively coupling the first input/output port 5A and the second input/output port 5B. Each of the plurality of dielectric resonators is a dielectric resonator according to the present embodiment.

The capacitor C10 is provided between the first input/output port 5A and the second input/output port 5B, and has a first end connected to the first input/output port 5A and a second end connected to the second input/output port 5B.

The plurality of dielectric resonators are provided between the first input/output port 5A and the second input/output port 5B in circuit configuration, and are configured so that two dielectric resonators adjacent to each other in circuit configuration are magnetically coupled to each other. As used herein, the phrase "in circuit configuration" is to describe layout in a circuit diagram, not in a physical configuration.

The present embodiment presents an example in which the dielectric filter 1 includes four dielectric resonators 2A, 2B, 2C, and 2D, as shown in FIG. 4. The dielectric resonators 2A, 2B, 2C, and 2D are arranged in this order, from closest to farthest, from the first input/output port 5A in circuit configuration. The dielectric resonators 2A, 2B, 2C, and 2D are configured so that: the dielectric resonators 2A and 2B are adjacent to each other in circuit configuration and are magnetically coupled to each other; the dielectric resonators 2B and 2C are adjacent to each other in circuit configuration and are magnetically coupled to each other; and the dielectric resonators 2C and 2D are adjacent to each other in circuit configuration and are magnetically coupled to each other. Each of the dielectric resonators 2A, 2B, 2C, and 2D has an inductance and a capacitance.

Hereinafter, the dielectric resonator 2A which is closest to the first input/output port 5A in circuit configuration will also be referred to as the first input/output stage resonator 2A, and the dielectric resonator 2D which is closest to the second input/output port 5B in circuit configuration will also be referred to as the second input/output stage resonator 2D. The other two dielectric resonators 2B and 2C lying between the first and second input/output stage resonators 2A and 2D in circuit configuration will also be referred to as the intermediate resonators 2B and 2C.

As shown in FIG. 4, the dielectric filter 1 further includes a first phase shifter 11A and a second phase shifter 11B. Each of the first and second phase shifters 11A and 11B causes a change in the phase of a signal passing therethrough. The amount of the change in the phase caused by each of the first and second phase shifters 11A and 11B will hereinafter be referred to as a phase change amount.

The first phase shifter 11A is provided between the first input/output port 5A and the first input/output stage resonator 2A in circuit configuration. The first phase shifter 11A is configured to be capacitively coupled to the first input/output stage resonator 2A. In FIG. 4, the capacitor symbol C11A represents the capacitive coupling between the first phase shifter 11A and the first input/output stage resonator 2A.

The second phase shifter 11B is provided between the second input/output port 5B and the second input/output stage resonator 2D in circuit configuration. The second phase shifter 11B is configured to be capacitively coupled to the second input/output stage resonator 2D. In FIG. 4, the capacitor symbol C11B represents the capacitive coupling between the second phase shifter 11B and the second input/output stage resonator 2D.

As shown in FIG. 1 to FIG. 3, the dielectric filter 1 includes a structure 20 for constructing the first and second input/output ports 5A and 5B, the dielectric resonators 2A, 2B, 2C and 2D, the capacitor C10 and the first and second phase shifters 11A and 11B.

The structure 20 includes a plurality of resonator body portions corresponding to the plurality of dielectric resonators, and a peripheral dielectric portion 4 lying around the plurality of resonator body portions. Each of the plurality of resonator body portions is formed of a first dielectric having a first relative permittivity εr1. The peripheral dielectric portion 4 is formed of a second dielectric having a second relative permittivity εr2 lower than the first relative permittivity εr1. An example of the first and second dielectrics is ceramic. In the present embodiment, specifically, the structure 20 includes four resonator body portions 3A, 3B, 3C, and 3D corresponding to the four dielectric resonators 2A, 2B, 2C, and 2D, respectively.

Hereinafter, the resonator body portion 3A corresponding to the first input/output stage resonator 2A will also be referred to as the first input/output stage resonator body portion 3A, and the resonator body portion 3D corresponding to the second input/output stage resonator 2D will also be referred to as the second input/output stage resonator body portion 3D. The resonator body portions 3B and 3C corresponding to the intermediate resonators 2B and 2C will also be referred to as the intermediate resonator body portions 3B and 3C.

In the present embodiment, the peripheral dielectric portion 4 is formed of a multilayer stack of a plurality of dielectric layers. Now, we define X, Y and Z directions as shown in FIG. 1 to FIG. 3. As shown, the X, Y and Z directions are orthogonal to each other. In the present embodiment, the plurality of dielectric layers are stacked in the Z direction (the upward direction in FIG. 1).

The peripheral dielectric portion 4 is in the shape of a rectangular solid and has an external surface. The external surface of the peripheral dielectric portion 4 includes a top surface 4*b* and a bottom surface 4*a* opposite to each other in the Z direction, and four side surfaces 4*c*, 4*d*, 4*e* and 4*f* connecting the top surface 4*b* and the bottom surface 4*a*. The side surfaces 4*c* and 4*d* are opposite to each other in the Y direction. The side surfaces 4*e* and 4*f* are opposite to each other in the X direction.

In the example shown in FIG. 1, each of the resonator body portions 3A to 3D has a cylindrical shape with a central axis in the Z direction. However, the shape of each of the resonator body portions 3A to 3D is not limited to a cylindrical shape, and may be, for example, a quadrangular prism shape. Each of the resonator body portions 3A to 3D may be formed of a collection of a plurality of rod-like members each formed of the first dielectric.

The resonator body portions 3A to 3D are configured so that the resonator body portions 3A and 3B are magnetically coupled to each other, the resonator body portions 3B and 3C are magnetically coupled to each other, and the resonator body portions 3C and 3D are magnetically coupled to each other.

As shown in FIG. 1, the structure 20 further includes a separation conductor layer 6 and a shield portion 7 each formed of a conductor.

The separation conductor layer 6 separates an area where the resonator body portions 3A to 3D lie from an area where the capacitor C10 lies.

The shield portion 7 lies around the resonator body portions 3A to 3D such that at least part of the peripheral dielectric portion 4 is interposed between the shield portion 7 and the resonator body portions 3A to 3D.

In the present embodiment, the separation conductor layer 6 also serves as part of the shield portion 7. The shield portion 7 includes the separation conductor layer 6, a shield conductor layer 72, and a connection portion 71. FIG. 3 omits the illustration of the shield conductor layer 72.

The separation conductor layer 6 and the shield conductor layer 72 are spaced apart from each other in the Z direction inside the peripheral dielectric portion 4. The separation conductor layer 6 lies near the bottom surface 4*a* of the peripheral dielectric portion 4. The shield conductor layer 72 lies near the top surface 4*b* of the peripheral dielectric portion 4. The resonator body portions 3A to 3D lie in the area between the separation conductor layer 6 and the shield conductor layer 72 within the structure 20. Each of the resonator body portions 3A to 3D has a top end face closest to the shield conductor layer 72 and a bottom end face closest to the separation conductor layer 6.

The connection portion 71 electrically connects the separation conductor layer 6 and the shield conductor layer 72. The connection portion 71 includes a plurality of through hole lines 71T. Each of the plurality of through hole lines 71T includes two or more through holes connected in series. The separation conductor layer 6, the shield conductor layer 72 and the connection portion 71 are arranged to surround the resonator body portions 3A to 3D. Each of the resonator body portions 3A to 3D is in non-contact with the shield portion 7.

As shown in FIGS. 1 and 3, the first input/output stage resonator body portion 3A and the second input/output stage resonator body portion 3D are physically adjacent to each other with neither of the intermediate resonator body portions 3B and 3C interposed therebetween. The resonator body portions 3A and 3D are aligned in the X direction near the side surface 4*c* of the peripheral dielectric portion 4. The resonator body portions 3B and 3C are aligned in the X direction near the side surface 4*d* of the peripheral dielectric portion 4.

As shown in FIG. 1, the structure 20 further includes a partition 8, a ground layer 9, and a connection portion 12 each formed of a conductor.

The partition 8 is intended to prevent the occurrence of magnetic coupling between the first input/output stage resonator body portion 3A and the second input/output stage resonator body portion 3D. The partition 8 is arranged to pass between the first input/output stage resonator body portion 3A and the second input/output stage resonator body portion 3D. The partition 8 electrically connects the separation conductor layer 6 and the shield conductor layer 72. The partition 8 includes a plurality of through hole lines 8T. Each of the plurality of through hole lines 8T includes two or more through holes connected in series.

The ground layer 9 is disposed on the bottom surface 4*a* of the peripheral dielectric portion 4. The connection portion 12 electrically connects the ground layer 9 and the separation conductor layer 6. The connection portion 12 includes a plurality of through hole lines 12T. Each of the plurality of through hole lines 12T includes two or more through holes connected in series.

The ground layer 9, the separation conductor layer 6 and the shield conductor layer 72 are all rectangular in shape as viewed in the Z direction.

As shown in FIG. 1, the structure 20 further includes coupling adjustment portions 13, 14 and 15 each formed of a conductor.

The coupling adjustment portion 13 is intended to adjust the magnitude of the magnetic coupling between the resonator body portions 3A and 3B. The coupling adjustment portion 14 is intended to adjust the magnitude of the magnetic coupling between the resonator body portions 3B and 3C. The coupling adjustment portion 15 is intended to adjust the magnitude of the magnetic coupling between the resonator body portions 3C and 3D. Each of the coupling adjustment portions 13, 14 and 15 electrically connects the separation conductor layer 6 and the shield conductor layer 72.

In the example shown in FIG. 1, the coupling adjustment portion 13 includes a single through hole line 13T. The coupling adjustment portion 14 includes a plurality of through hole lines 14T. The coupling adjustment portion 15 includes a single through hole line 15T. Each of the through hole lines 13T, 14T and 15T includes two or more through holes connected in series.

The dielectric resonator 2A is composed of the resonator body portion 3A, at least part of the peripheral dielectric portion 4, and the shield portion 7. The dielectric resonator 2B is composed of the resonator body portion 3B, at least part of the peripheral dielectric portion 4, and the shield portion 7. The dielectric resonator 2C is composed of the resonator body portion 3C, at least part of the peripheral dielectric portion 4, and the shield portion 7. The dielectric resonator 2D is composed of the resonator body portion 3D, at least part of the peripheral dielectric portion 4, and the shield portion 7.

In the present embodiment, the resonance mode of each of the dielectric resonators 2A to 2D is a TM mode. An electromagnetic field generated by the dielectric resonators 2A to 2D is present inside and outside the resonator body portions 3A to 3D. The shield portion 7 has a function of confining the electromagnetic field outside the resonator body portions 3A to 3D to within the area surrounded by the shield portion 7.

Reference is now made to FIGS. 5 to 13 to describe an example of the plurality of dielectric layers constituting the peripheral dielectric portion 4 and an example of the configurations of a plurality of conductor layers formed on the dielectric layers and a plurality of through holes formed in the dielectric layers. In this example, the peripheral dielectric portion 4 has thirty-two dielectric layers stacked together. The thirty-two dielectric layers will hereinafter be referred to as the first to thirty-second dielectric layers, respectively, in the order from bottom to top. The first to thirty-second dielectric layers will be denoted by the reference numerals 31 to 62, respectively. In FIGS. 5 to 12, each small circle represents a through hole.

Figure 5:
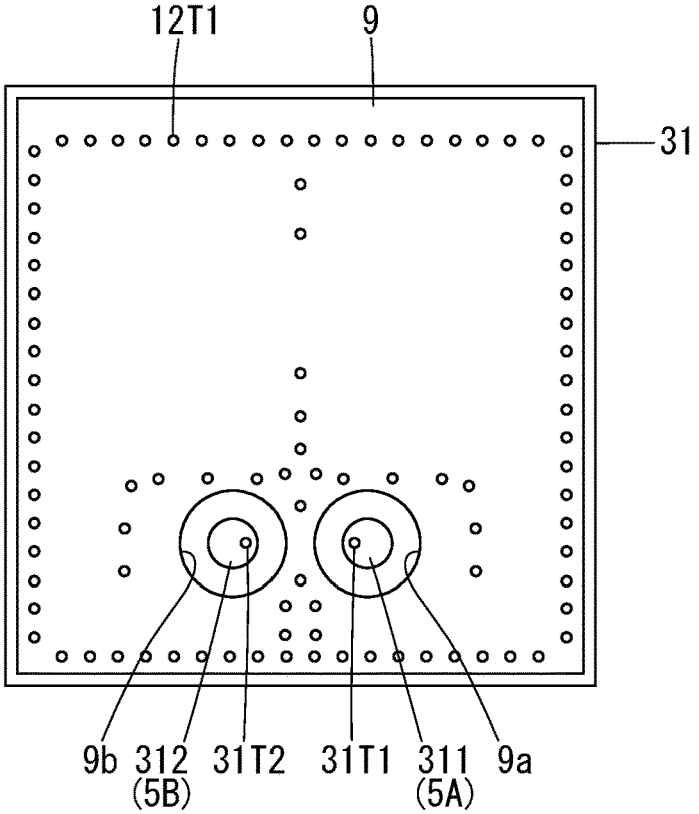
FIG. 5 is a plan view illustrating a patterned surface of a first dielectric layer of a peripheral dielectric portion shown in FIG. 1.

FIG. 5 illustrates a patterned surface of the first dielectric layer 31. On the patterned surface of the dielectric layer 31, there are formed the ground layer 9, a conductor layer 311 forming the first input/output port 5A, and a conductor layer 312 forming the second input/output port 5B. Two circular holes 9*a* and 9*b* are formed in the ground layer 9. The conductor layer 311 lies inside the hole 9*a*, and the conductor layer 312 lies inside the hole 9*b*.

Further, a through hole 31T1 connected to the conductor layer 311, and a through hole 31T2 connected to the conductor layer 312 are formed in the dielectric layer 31. Further formed in the dielectric layer 31 are a plurality of through holes 12T1 constituting respective portions of the plurality of through hole lines 12T. All the through holes in FIG. 5 except the through holes 31T1 and 31T2 are the through holes 12T1. The through holes 12T1 are connected to the ground layer 9.

Figure 6:
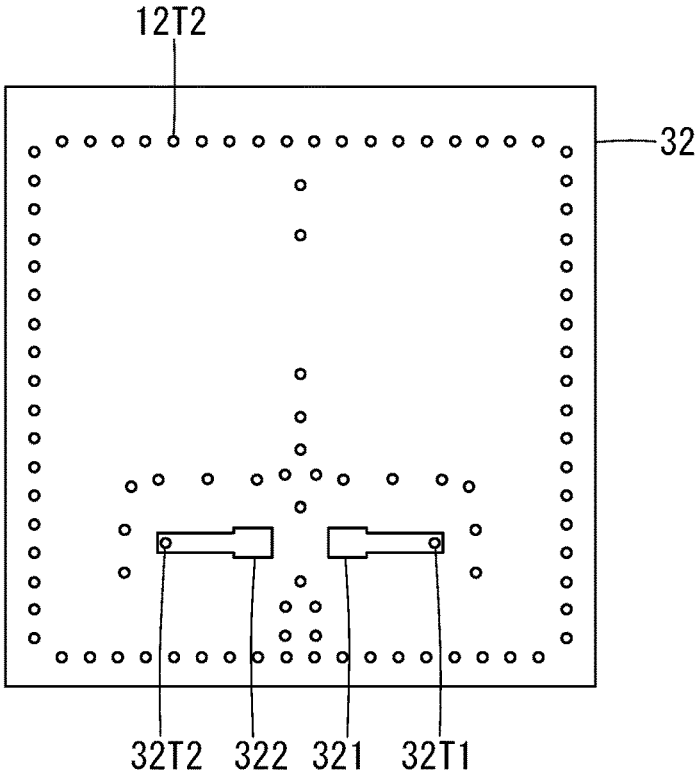
FIG. 6 is a plan view illustrating a patterned surface of a second dielectric layer of the peripheral dielectric portion shown in FIG. 1.

FIG. 6 illustrates a patterned surface of the second dielectric layer 32. On the patterned surface of the dielectric layer 32, there are formed conductor layers 321 and 322 which are long in the X direction. Each of the conductor layers 321 and 322 has a first end and a second end opposite to each other. The first end of the conductor layer 321 is opposed to the first end of the conductor layer 322. The through hole 31T1 shown in FIG. 5 is connected to a portion of the conductor layer 321 near the first end thereof. The through hole 31T2 shown in FIG. 5 is connected to a portion of the conductor layer 322 near the first end thereof.

Further formed in the dielectric layer 32 are a through hole 32T1 connected to a portion of the conductor layer 321 near the second end thereof, and a through hole 32T2 connected to a portion of the conductor layer 322 near the second end thereof. Further formed in the dielectric layer 32 are a plurality of through holes 12T2 constituting respective portions of the plurality of through hole lines 12T. All the through holes in FIG. 6 except the through holes 32T1 and 32T2 are the through holes 12T2. The through holes 12T1 shown in FIG. 5 are respectively connected to the through holes 12T2.

Figure 7:
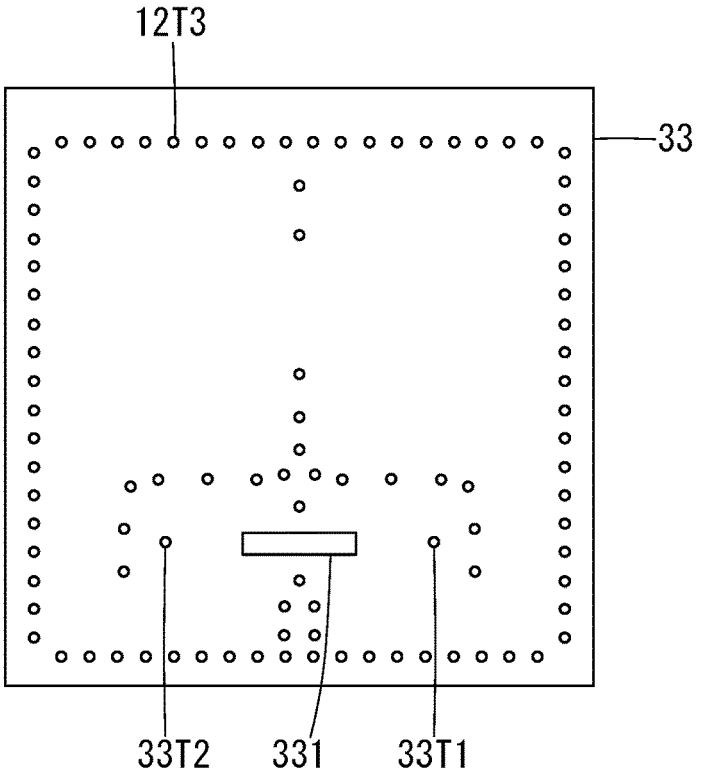
FIG. 7 is a plan view illustrating a patterned surface of a third dielectric layer of the peripheral dielectric portion shown in FIG. 1.

FIG. 7 illustrates a patterned surface of the third dielectric layer 33. A conductor layer 331 long in the X direction is formed on the patterned surface of the dielectric layer 33. A portion of the conductor layer 331 is opposed to the portion of the conductor layer 321 near the first end thereof with the dielectric layer 32 interposed therebetween. Another portion of the conductor layer 331 is opposed to the portion of the conductor layer 322 near the first end thereof with the dielectric layer 32 interposed therebetween.

Further formed in the dielectric layer 33 are through holes 33T1 and 33T2, and through holes 12T3 constituting respective portions of the through hole lines 12T. The through holes 32T1 and 32T2 shown in FIG. 6 are connected to the through holes 33T1 and 33T2, respectively. All the through holes in FIG. 7 except the through holes 33T1 and 33T2 are the through holes 12T3. The through holes 12T2 shown in FIG. 6 are respectively connected to the through holes 12T3.

Figure 8:
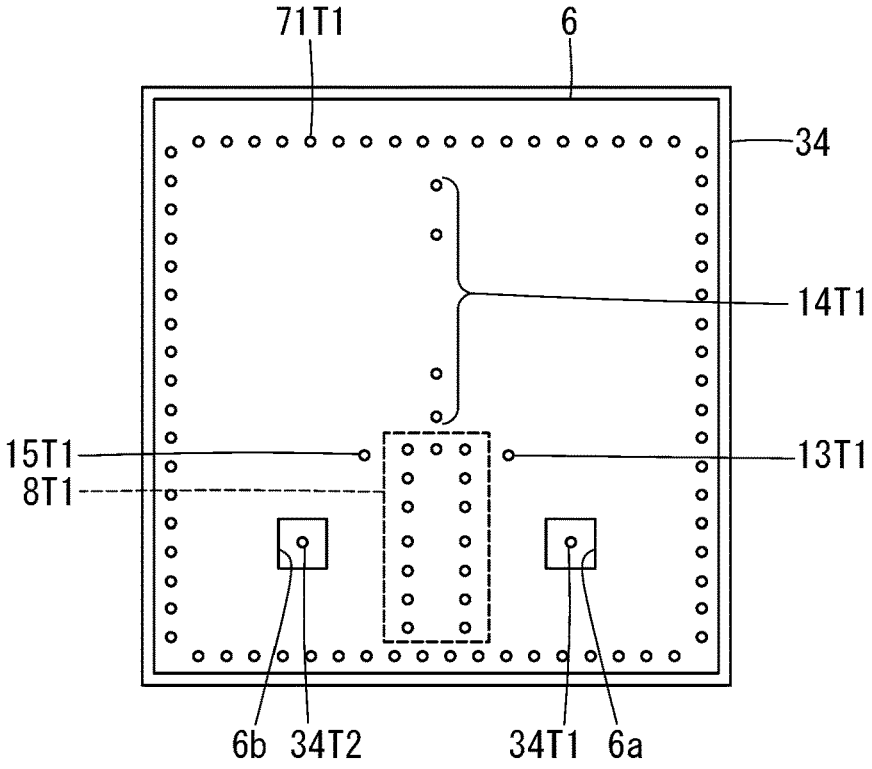
FIG. 8 is a plan view illustrating a patterned surface of a fourth dielectric layer of the peripheral dielectric portion shown in FIG. 1.

FIG. 8 illustrates a patterned surface of the fourth dielectric layer 34. The separation conductor layer 6 is formed on the patterned surface of the dielectric layer 34. Two rectangular holes **6*a* and 6*b* are formed in the separation conductor layer 6**.

Through holes 34T1 and 34T2 are formed in the dielectric layer 34. Further formed in the dielectric layer 34 are through holes 8T1, 13T1, 14T1, 15T1, and 71T1 constituting respective portions of the through hole lines 8T, 13T, 14T, 15T, and 71T. All the through holes in FIG. 8 except the through holes 34T1, 34T2, 8T1, 13T1, 14T1 and 15T1 are the through holes 71T1.

The through hole 34T1 lies inside the hole **6*a*, and the through hole 34T2 lies inside the hole 6*b*. The through holes 33T1 and 33T2 shown in FIG. 7 are connected to the through holes 34T1 and 34T2**, respectively.

In FIG. 8, all the through holes except the through holes 34T1 and 34T2 are connected to the separation conductor layer 6. The separation conductor layer 6 has a rectangular perimeter. The through holes 71T1 are connected to the separation conductor layer 6 at its areas near the perimeter.

Figure 9:
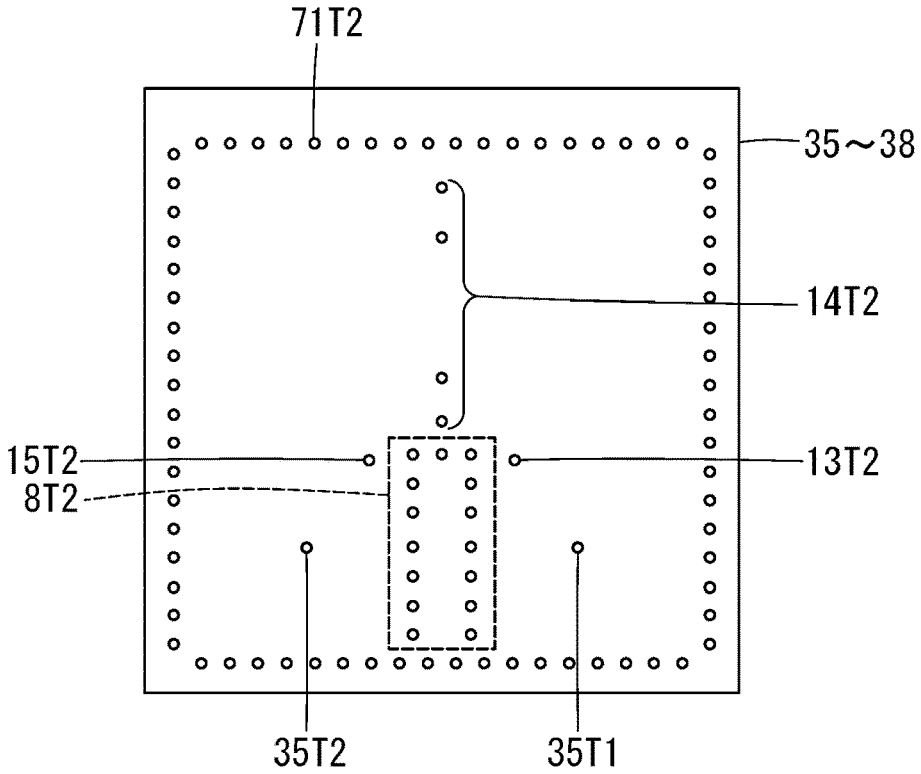
FIG. 9 is a plan view illustrating a patterned surface of each of a fifth to an eighth dielectric layer of the peripheral dielectric portion shown in FIG. 1.

FIG. 9 illustrates a patterned surface of each of the fifth to eighth dielectric layers 35 to 38. Through holes 35T1 and 35T2 are formed in each of the dielectric layers 35 to 38. Further formed in each of the dielectric layers 35 to 38 are through holes 8T2, 13T2, 14T2, 15T2, and 71T2 constituting respective portions of the through hole lines 8T, 13T, 14T, 15T, and 71T. All the through holes in FIG. 9 except the through holes 35T1, 35T2, 8T2, 13T2, 14T2 and 15T2 are the through holes 71T2.

The through holes 34T1, 34T2, 8T1, 13T1, 14T1, 15T1, and 71T1 shown in FIG. 8 are respectively connected to the through holes 35T1, 35T2, 8T2, 13T2, 14T2, 15T2, and 71T2 formed in the fifth dielectric layer 35. In the dielectric layers 35 to 38, every vertically adjacent through holes denoted by the same reference signs are connected to each other.

Figure 10:
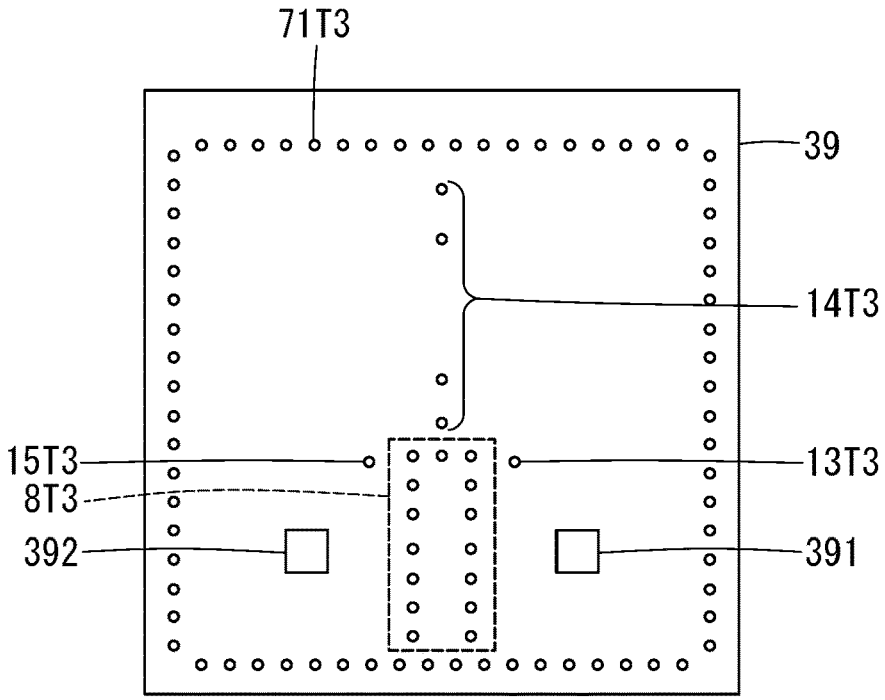
FIG. 10 is a plan view illustrating a patterned surface of a ninth dielectric layer of the peripheral dielectric portion shown in FIG. 1.

FIG. 10 illustrates a patterned surface of the ninth dielectric layer 39. Conductor layers 391 and 392 are formed on the patterned surface of the dielectric layer 39. The through holes 35T1 and 35T2 formed in the eighth dielectric layer 38 are connected to the conductor layers 391 and 392, respectively.

Further formed in the dielectric layer 39 are through holes 8T3, 13T3, 14T3, 15T3, and 71T3 constituting respective portions of the through hole lines 8T, 13T, 14T, 15T, and 71T. All the through holes in FIG. 10 except the through holes 8T3, 13T3, 14T3, and 15T3 are the through holes 71T3.

The through holes 8T2, 13T2, 14T2, 15T2, and 71T2 formed in the eighth dielectric layer 38 are respectively connected to the through holes 8T3, 13T3, 14T3, 15T3, and 71T3 formed in the dielectric layer 39.

Figure 11:
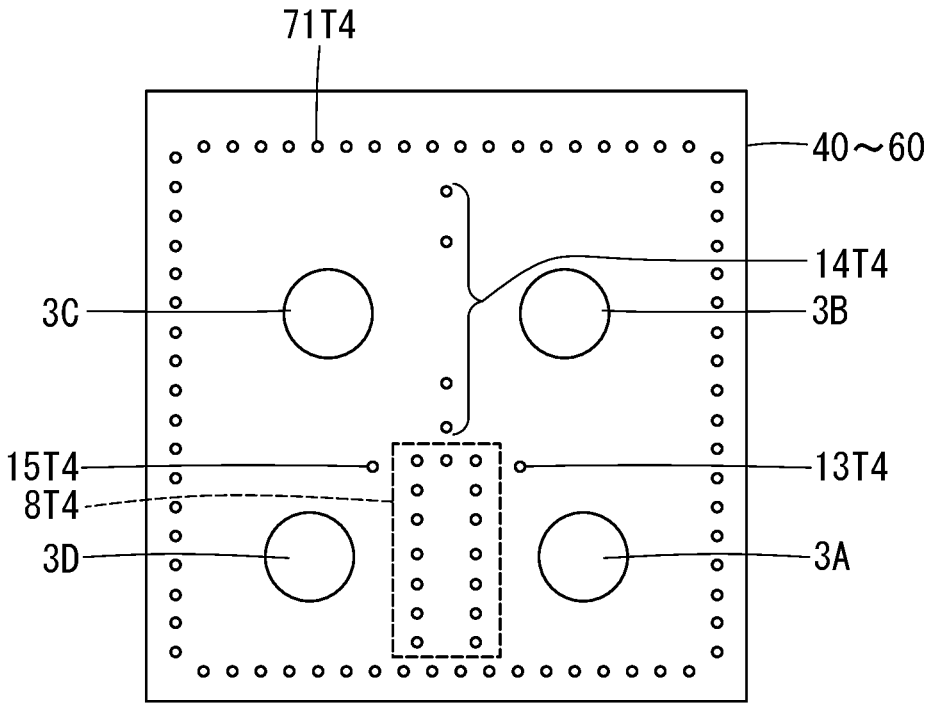
FIG. 11 is a plan view illustrating a patterned surface of each of a tenth to a thirtieth dielectric layer of the peripheral dielectric portion shown in FIG. 1.

FIG. 11 illustrates a patterned surface of each of the tenth to thirtieth dielectric layers 40 to 60. In each of the dielectric layers 40 to 60, there are formed through holes 8T4, 13T4, 14T4, 15T4, and 71T4 constituting respective portions of the through hole lines 8T, 13T, 14T, 15T, and 71T. All the through holes in FIG. 11 except the through holes 8T4, 13T4, 14T4, and 15T4 are the through holes 71T4.

The through holes 8T3, 13T3, 14T3, 15T3, and 71T3 shown in FIG. 10 are respectively connected to the through holes 8T4, 13T4, 14T4, 15T4, and 71T4 formed in the tenth dielectric layer 40. In the dielectric layers 40 to 60, every vertically adjacent through holes denoted by the same reference signs are connected to each other.

The resonator body portions 3A to 3D are provided to penetrate the dielectric layers 40 to 60. The conductor layer 391 shown in FIG. 10 is opposed to the bottom end face of the resonator body portion 3A with the dielectric layer 39 interposed therebetween. The conductor layer 392 shown in FIG. 10 is opposed to the bottom end face of the resonator body portion 3D with the dielectric layer 39 interposed therebetween.

Figure 12:
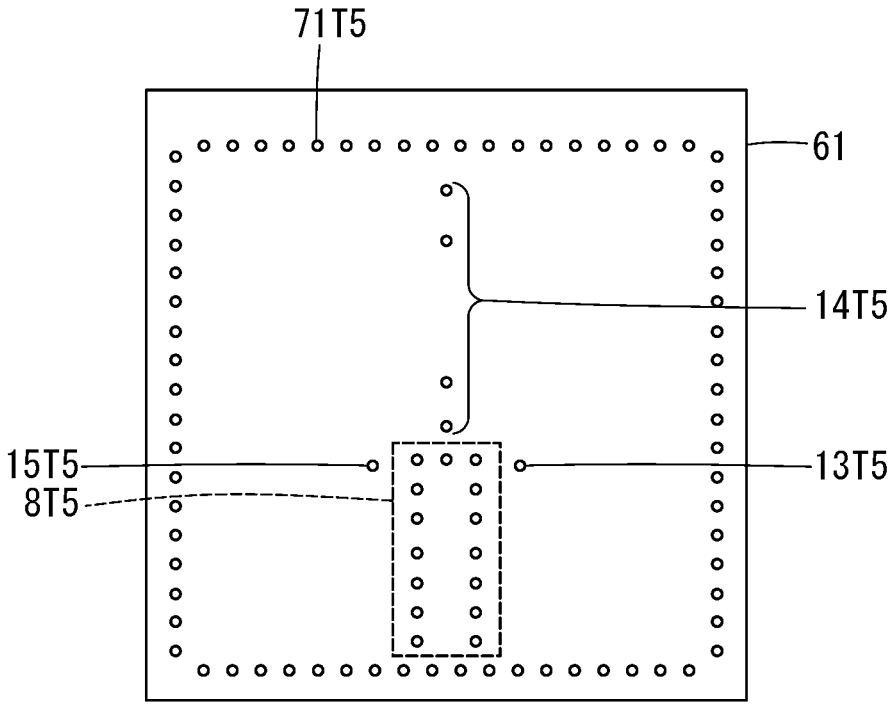
FIG. 12 is a plan view illustrating a patterned surface of a thirty-first dielectric layer of the peripheral dielectric portion shown in FIG. 1.

FIG. 12 illustrates a patterned surface of the thirty-first dielectric layer 61. In the dielectric layer 61, there are formed through holes 8T5, 13T5, 14T5, 15T5, and 71T5 constituting respective portions of the through hole lines 8T, 13T, 14T, 15T, and 71T. All the through holes in FIG. 12 except the through holes 8T5, 13T5, 14T5, and 15T5 are the through holes 71T5.

The through holes 8T4, 13T4, 14T4, 15T4, and 71T4 formed in the thirtieth dielectric layer 60 are respectively connected to the through holes 8T5, 13T5, 14T5, 15T5, and 71T5 formed in the dielectric layer 61.

Figure 13:
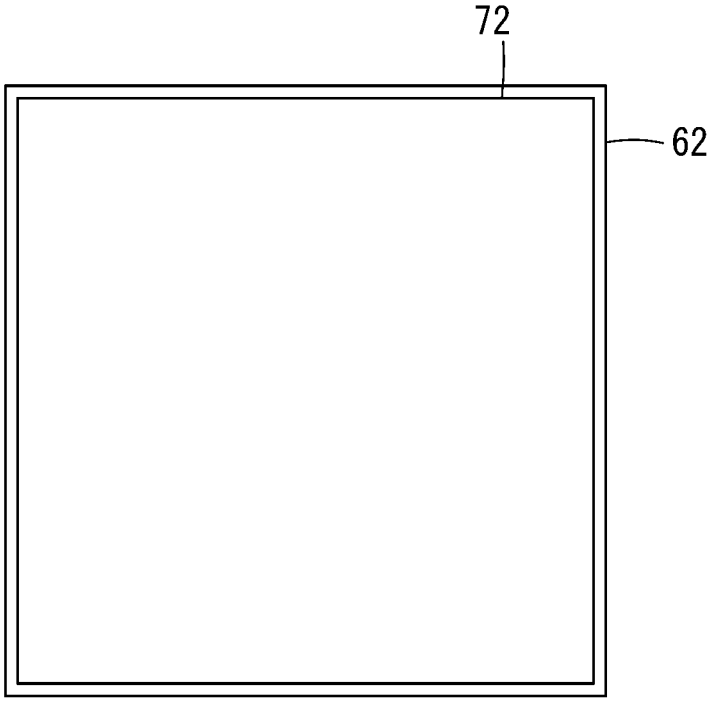
FIG. 13 is a plan view illustrating a patterned surface of a thirty-second dielectric layer of the peripheral dielectric portion shown in FIG. 1.

FIG. 13 illustrates a patterned surface of the thirty-second dielectric layer 62. The shield conductor layer 72 is formed on the patterned surface of the dielectric layer 62. The through holes 8T5, 13T5, 14T5, 15T5, and 71T5 shown in FIG. 12 are connected to the shield conductor layer 72.

The peripheral dielectric portion 4 is formed by stacking the dielectric layers 31 to 62 such that the patterned surface of the dielectric layer 31 shown in FIG. 5 constitutes the bottom surface 4*a* of the peripheral dielectric portion 4.

The capacitor C10 shown in FIG. 4 is composed of the conductor layer 331 shown in FIG. 7, the conductor layers 321 and 322 shown in FIG. 2, and the dielectric layer 32 interposed between the conductor layer 331 and the conductor layers 321, 322. The capacitor C10 lies in the area between the separation conductor layer 6 and the ground layer 9 within the structure 20. As previously mentioned, the resonator body portions 3A to 3D lie in the area between the separation conductor layer 6 and the shield conductor layer 72 within the structure 20. The separation conductor layer 6 thus separates the area where the resonator body portions 3A to 3D lie from the area where the capacitor C10 lies.

Some of the plurality of through hole lines 12T constituting the connection portion 12 are arranged to surround the conductor layers 321, 322, and 331 constituting the capacitor C10.

As shown in FIG. 2, the conductor layer 321 and the conductor layer 391 are connected to each other by a through hole line 11AT constituted of the through holes 32T1, 33T1, 34T1 and 35T1 connected in series. The conductor layer 322 and the conductor layer 392 are connected to each other by a through hole line 11BT constituted of the through holes 32T2, 33T2, 34T2 and 35T2 connected in series.

The first phase shifter 11A is composed of the conductor layer 321 and the through hole line 11AT. The second phase shifter 11B is composed of the conductor layer 322 and the through hole line 11BT.

The conductor layer 391 is opposed to the bottom end face of the resonator body portion 3A with the dielectric layer 39 interposed therebetween. The capacitive coupling C11A between the first phase shifter 11A and the first input/output stage resonator 2A is thereby provided. The conductor layer 392 is opposed to the bottom end face of the resonator body portion 3D with the dielectric layer 39 interposed therebetween. The capacitive coupling C11B between the second phase shifter 11B and the second input/output stage resonator 2D is thereby provided.

It should be noted that the dielectric layers 31, 32 and 33 need not necessarily be used as constituents of the peripheral dielectric portion 4, and the peripheral dielectric portion 4 may thus be constituted of the dielectric layers 34 to 62 stacked. In such a case, the dielectric forming the dielectric layers 31, 32 and 33 may have a relative permittivity higher than or equal to the first relative permittivity εr1 of the first dielectric forming the resonator body portions 3A to 3D.

Next, a manufacturing method for the dielectric filter 1 according to the present embodiment will be described. This manufacturing method includes a step of fabricating an unfired multilayer stack which is to be fired later into the structure 20, and a step of subjecting the unfired multilayer stack to firing to complete the structure 20.

In the step of fabricating the unfired multilayer stack, a plurality of unfired ceramic sheets, which are to become the dielectric layers 31 to 62 later, are fabricated first. Next, a plurality of unfired through holes are formed in ones of the ceramic sheets that correspond to ones of the dielectric layers that each have a plurality of through holes formed therein. Further, one or more unfired conductor layers are formed on ones of the ceramic sheets that correspond to ones of the dielectric layers that each have one or more conductor layers formed thereon. Hereinafter, a ceramic sheet having either a plurality of unfired through holes formed therein or one or more unfired conductor layers formed thereon, or both, will be referred to as an unfired sheet.

In the step of fabricating the the unfired multilayer stack, a plurality of unfired sheets corresponding to the dielectric layers 40 to 60 shown in FIG. 11 are then stacked together to form a part of the unfired multilayer stack. Next, four accommodation portions for accommodating the resonator body portions 3A to 3D are formed in the part of the unfired multilayer stack. The resonator body portions 3A to 3D are then accommodated into the four accommodation portions. Next, the part of the unfired multilayer stack and a plurality of unfired sheets constituting the remaining part of the unfired multilayer stack are stacked together to complete the unfired multilayer stack.

The dielectric filter 1 according to the present embodiment has a band-pass filter function. The dielectric filter 1 is designed and configured to have a passband in, for example, a quasi-millimeter wave band of 10 to 30 GHz or a millimeter wave band of 30 to 300 GHz. Note that the passband refers to, for example, a frequency band between two frequencies at which the insertion loss is higher by 3 dB than the minimum value of the insertion loss. Each of the dielectric resonators 2A to 2D is designed and configured to have a resonant frequency f0 in, for example, a quasi-millimeter wave band of 10 to 30 GHz or a millimeter wave band of 30 to 300 GHz. The center frequency fc of the passband of the dielectric filter 1 depends on the resonant frequency f0 of each of the dielectric resonator 2A to 2D, and is close to the resonant frequency f0.

The characteristics of the dielectric resonators 2A to 2D and the dielectric filter 1 according to the present embodiment will now be described. In the present embodiment, the resonator body portions 3A to 3D are formed of the first dielectric, and the peripheral dielectric portion 4 is formed of the second dielectric. Either one of a temperature coefficient tf1H of resonant frequency of the first dielectric at 25° C. to 85° C. and a temperature coefficient tf2H of resonant frequency of the second dielectric at 25° C. to 85° C. has a positive value and the other has a negative value.

In the present embodiment, either one of a temperature coefficient tf1L of resonant frequency of the first dielectric at −40° C. to 25° C. and a temperature coefficient tf2L of resonant frequency of the second dielectric at −40° C. to 25° C. has a positive value and the other has a negative value.

Now, the temperature coefficients of resonant frequency of dielectric materials including the first and second dielectrics will be described. Let fref represent the resonant frequency of a dielectric material at a reference temperature Tref. Let fr represent the resonant frequency of the dielectric material at a predetermined temperature Tr. Let tf represent the temperature coefficient of resonant frequency of the dielectric material in a temperature range from the reference temperature Tref to the temperature Tr. The temperature coefficient tf of resonant frequency is expressed by Eq. (1) below.

$$tf=[(fr-\mathrm{fref})/\{\mathrm{fref}(Tr-\mathrm{Tref})\}]\times 10^6(\mathrm{ppm}/^\circ\ \mathrm{C.}) \quad (1)$$

The temperature coefficient tf1H is the temperature coefficient of resonant frequency of the first dielectric obtained from Eq. (1) with a reference temperature Tref of 25° C. and a predetermined temperature Tr of 85° C. The temperature coefficient tf2H is the temperature coefficient of resonant frequency of the second dielectric obtained from Eq. (1)

with a reference temperature Tref of 25° C. and a predetermined temperature Tr of 85° C.

The temperature coefficient tf1L is the temperature coefficient of resonant frequency of the first dielectric obtained from Eq. (1) with a reference temperature Tref of 25° C. and a predetermined temperature Tr of −40° C. The temperature coefficient tf2L is the temperature coefficient of resonant frequency of the second dielectric obtained from Eq. (1) with a reference temperature Tref of 25° C. and a predetermined temperature Tr of −40° C.

To determine whether a dielectric material of which relative permittivity and resonant frequency are unknown satisfies the requirements of the first or second dielectric of the present embodiment, the relative permittivity and the resonant frequency of the dielectric material need to be measured. For example, the two-dielectric resonator method standardized in the international standard IEC 61338-1-3 (1999) or the one-dielectric resonator method standardized in the international standard IEC 61788-7 (2002) can be used as a method for measuring the relative permittivity and the resonant frequency of the dielectric material.

Hereinafter, any one of the dielectric resonators 2A to 2D will be referred to as a dielectric resonator 2, and the resonator body portion corresponding to the dielectric resonator 2 will be referred to as a resonator body portion 3. In the present embodiment, a temperature coefficient tf0H of the resonant frequency f0 of the dielectric resonator 2 at 25° C. to 85° C. and a temperature coefficient tf0L of the resonant frequency f0 of the dielectric resonator 2 at −40° C. to 25° C. are defined as described below.

The temperature coefficient tf0H is a value obtained from Eq. (1) by replacing fref in Eq. (1) with the resonant frequency f0 of the dielectric resonator 2 at the reference temperature Tref, replacing fr in Eq. (1) with the resonant frequency f0 of the dielectric resonator 2 at the predetermined temperature Tr, assuming the reference temperature Tref to be 25° C., and assuming the predetermined temperature Tr to be 85° C.

The temperature coefficient tf0L is a value obtained from Eq. (1) by replacing fref in Eq. (1) with the resonant frequency f0 of the dielectric resonator 2 at the reference temperature Tref, replacing fr in Eq. (1) with the resonant frequency f0 of the dielectric resonator 2 at the predetermined temperature Tr, assuming the reference temperature Tref to be 25° C., and assuming the predetermined temperature Tr to be −40° C.

In the present embodiment, a temperature coefficient tfcH of the center frequency fc of the passband of the dielectric filter 1 at 25° C. to 85° C. and a temperature coefficient tfcL of the center frequency fc of the passband of the dielectric filter 1 at −40° C. to 25° C. are defined as described below.

The temperature coefficient tfcH is a value obtained from Eq. (1) by replacing fref in Eq. (1) with the center frequency fc at the reference temperature Tref, replacing fr in Eq. (1) with the center frequency fc at the predetermined temperature Tr, assuming the reference temperature Tref to be 25° C., and assuming the predetermined temperature Tr to be 85° C.

The temperature coefficient tfcL is a value obtained from Eq. (1) by replacing fref in Eq. (1) with the center frequency fc at the reference temperature Tref, replacing fr in Eq. (1) with the center frequency fc at the predetermined temperature Tr, assuming the reference temperature Tref to be 25° C., and assuming the predetermined temperature Tr to be −40° C.

It is desired of the dielectric resonator 2 that a change in the resonant frequency f0 in response to a change in temperature be small, i.e., the absolute value of the temperature coefficient tf0H and the absolute value of the temperature coefficient tf0L be small.

It is desired of the dielectric filter 1 that a change in the center frequency fc of the passband in response to a change in temperature be small, i.e., the absolute value of the temperature coefficient tfcH and the absolute value of the temperature coefficient tfcL be small.

In the present embodiment, as described above, either one of the temperature coefficients tf1H and tf2H has a positive value and the other has a negative value. This enables reduction of the absolute values of the temperature coefficient tf0H and the temperature coefficient tfcH. Further, in the present embodiment, either one of the temperature coefficients tf1L and tf2L has a positive value and the other has a negative value. This enables reduction of the absolute values of the temperature coefficient tf0L and the temperature coefficient tfcL.

Now, a description will be given of the reason why making either one of the temperature coefficients tf1H and tf2H have a positive value and the other a negative value enables reduction of the absolute value of the temperature coefficient tf0H.

The resonant frequency f0 of the dielectric resonator 2 depends on the electrical length of the dielectric resonator 2. An electromagnetic field generated by the dielectric resonator 2 lies inside and outside the resonator body portion 3. The electrical length of the dielectric resonator 2 thus varies depending on the first relative permittivity εr1 of the first dielectric forming the resonator body portion 3 and the second relative permittivity εr2 of the second dielectric forming the peripheral dielectric portion 4. The resonant frequency f0 of the dielectric resonator 2 therefore varies depending on the relative permittivities εr1 and εr2. Specifically, the resonant frequency f0 decreases as the relative permittivity εr1 increases, and increases as the relative permittivity εr1 decreases. Likewise, the resonant frequency f0 decreases as the relative permittivity εr2 increases, and increases as the relative permittivity εr2 decreases.

On the other hand, the resonant frequency of the first dielectric varies depending on the first relative permittivity εr1, and the resonant frequency of the second dielectric varies depending on the second relative permittivity εr2. Specifically, the resonant frequency of the first dielectric decreases as the relative permittivity εr1 increases, and increases as the relative permittivity εr1 decreases. Likewise, the resonant frequency of the second dielectric decreases as the relative permittivity εr2 increases, and increases as the relative permittivity εr2 decreases.

In other words, if a temperature change occurs and the resonant frequency of the first dielectric increases, the first relative permittivity εr1 decreases. This functions to increase the resonant frequency f0 of the dielectric resonator 2. Conversely, if a temperature change occurs and the resonant frequency of the first dielectric decreases, the first relative permittivity εr1 increases. This functions to decrease the resonant frequency f0 of the dielectric resonator 2.

Likewise, if a temperature change occurs and the resonant frequency of the second dielectric increases, the second relative permittivity εr2 decreases. This functions to increase the resonant frequency f0 of the dielectric resonator 2. Conversely, if a temperature change occurs and the resonant frequency of the second dielectric decreases, the second relative permittivity εr2 increases. This functions to decrease the resonant frequency f0 of the dielectric resonator 2.

Accordingly, making either one of the temperature coefficients tf1H and tf2H have a positive value and the other a negative value enables reduction of a change in the resonant frequency f0 with respect to a change in temperature from 25° C. to 85° C., that is, reduction of the absolute value of the temperature coefficient tf0H.

For the same reason, making either one of the temperature coefficients tf1L and tf2L have a positive value and the other a negative value enables reduction of a change in the resonant frequency f0 with respect to a change in temperature from 25° C. to −40° C., that is, reduction of the absolute value of the temperature coefficient tf0L.

The center frequency fc of the passband of the dielectric filter 1 depends on the resonant frequency f0 of the dielectric resonator 2. Thus, making either one of the temperature coefficients tf1H and tf2H have a positive value and the other a negative value enables reduction of the absolute value of the temperature coefficient tfcH. Likewise, making either one of the temperature coefficients tf1L and tf2L have a positive value and the other a negative value enables reduction of the absolute value of the temperature coefficient tfcL.

The temperature coefficient tf0H has an intermediate value between the temperature coefficient tf1H and the temperature coefficient tf2H. The temperature coefficient tf0L has an intermediate value between the temperature coefficient tf1L and the temperature coefficient tf2L. The present embodiment thus enables the temperature coefficients tf0H, tfcH, tf0L, and tfcL to be small in absolute value even if the absolute values of tf1H, tf2H, tf1L, and tf2L are large.

The absolute value of the temperature coefficient tf0H is preferably smaller than the absolute value of the temperature coefficient tf1H and the absolute value of the temperature coefficient tf2H. The absolute value of the temperature coefficient tf0L is preferably smaller than the absolute value of the temperature coefficient tf1L and the absolute value of the temperature coefficient tf2L.

Next, desirable ranges of the absolute values of the temperature coefficients tf0H and tf0L will be described. Suppose that the target value of the upper limit of the rate of change in the resonant frequency f0 of the dielectric resonator 2 in response to a change in temperature is 0.2%. If the rate of change in the resonant frequency f0 with respect to a change in temperature from 25° C. to 85° C. is 0.2%, the absolute value of the temperature coefficient tf0H is approximately 33 ppm/° C. If the rate of change in the resonant frequency f0 with respect to a change in temperature from 25° C. to −40° C. is 0.2%, the absolute value of the temperature coefficient tf0L is approximately 30 ppm/° C. It is therefore preferred that the temperature coefficient tf0H be 33 ppm/° C. or less in absolute value, and that the temperature coefficient tf0L be 30 ppm/° C. or less in absolute value. It is more preferred that the temperature coefficients tf0H and tf0L be 10 ppm/° C. or less in absolute value.

The temperature coefficient of the resonant frequency f0 of the dielectric resonator 2 according to the present embodiment depends on the temperature coefficient of resonant frequency of the first dielectric and the temperature coefficient of resonant frequency of the second dielectric. In this case, the absolute value of the temperature coefficient of the resonant frequency f0 of the dielectric resonator 2 is not necessarily reduced by simply reducing the absolute value of the temperature coefficient of resonant frequency of the first dielectric. Further, any attempts to reduce the absolute value of the temperature coefficient of resonant frequency of the first dielectric result in limitations on materials that can be used as the first dielectric. This can sacrifice other characteristics of the first dielectric than the temperature coefficient of resonant frequency, such as the relative permittivity and Q value, and can consequently sacrifice the characteristics of the dielectric resonator 2.

According to the present embodiment, the degree of freedom in selecting materials usable as the first dielectric increases. It is thus possible to reduce the temperature coefficient of the resonant frequency f0 of the dielectric resonator 2 in absolute value without sacrificing the characteristics of the dielectric resonator 2.

Now, a description will be given of a dielectric filter of a first example and dielectric filters of first and second comparative examples used in a simulation. The dielectric filter of the first example is an example of the dielectric filter 1 according to the present embodiment. Each of the dielectric filters of the first and second comparative examples is the same as the dielectric filter of the first example except that the temperature coefficients tf1H, tf1L, tf2H and tf2L do not satisfy the requirements for the first and second dielectrics of the present embodiment.

In the first example, the first relative permittivity εr1 of the first dielectric is 40, and the temperature coefficients tf1H and tf1L are both 120 ppm/° C. Further, in the first example, the second relative permittivity εr2 of the second dielectric is 7.43, and the temperature coefficients tf2H and tf2L are both −65 ppm/° C.

For the first example, the temperature coefficient tf0H was 3.2 ppm/° C., the temperature coefficient tf0L was 2.1 ppm/° C., the temperature coefficient tfcH was −4.4 ppm/° C., and the temperature coefficient tfcL was −2.7 ppm/° C.

Table 1 below summarizes the foregoing values of the plurality of temperature characteristics of the first example.

TABLE 1

| | Temperature coefficient (ppm/° C.) | | | |
|---|---|---|---|---|
| Temperature range (° C.) | First dielectric (∈r1 = 40) | Second dielectric (∈r2 = 7.43) | Dielectric resonator | Dielectric filter |
| 25 to 85 | (tf1H) 120 | (tf2H) −65 | (tf0H) 3.2 | (tfcH) −4.4 |
| −40 to 25 | (tf1L) 120 | (tf2L) −65 | (tf0L) 2.1 | (tfcL) −2.7 |

Figure 14:
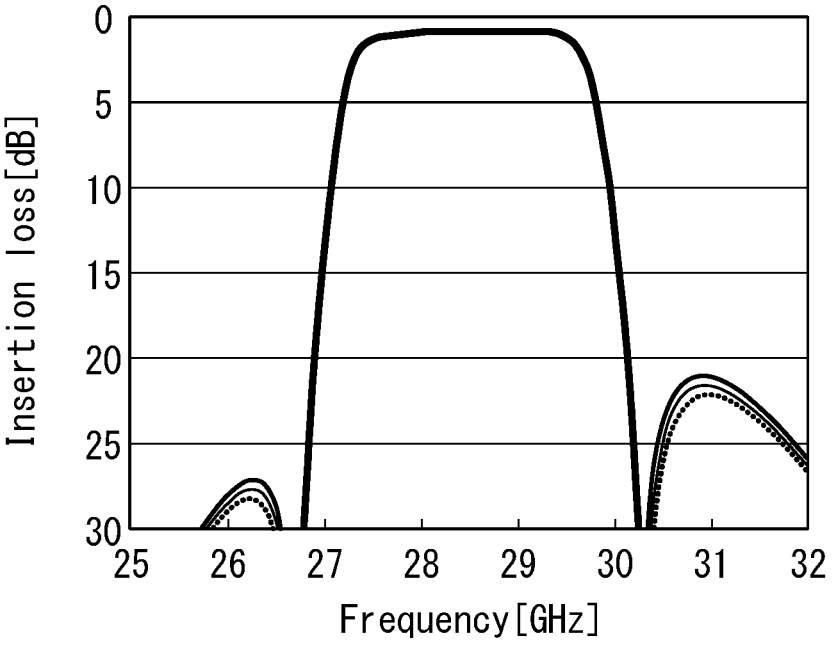
FIG. 14 is a characteristic diagram illustrating frequency responses of the insertion loss of a dielectric filter of a first example.

FIG. 14 illustrates the frequency responses of the insertion loss of the dielectric filter of the first example. In FIG. 14, the horizontal axis represents frequency, and the vertical axis represents insertion loss. In FIG. 14, the dotted line represents the frequency response at −40° C. The thin solid line represents the frequency response at 25° C., and the thick solid line represents the frequency response at 85° C.

In the first comparative example, the first relative permittivity εr1 of the first dielectric is 40, and the temperature coefficients tf1H and tf1L are both −65 ppm/° C. Further, in the first comparative example, the second relative permittivity εr2 of the second dielectric is 7.43, and the temperature coefficients tf2H and tf2L are both −65 ppm/° C. Thus, in the first comparative example, all the temperature coefficients tf1H, tf1L, tf2H and tf2L have a negative value, and are equal to the temperature coefficients tf2H and tf2L of the first example.

For the first comparative example, the temperature coefficient tf0H was −64.6 ppm/° C., the temperature coefficient tf0L was −65.4 ppm/° C., the temperature coefficient tfcH was −52.9 ppm/° C., and the temperature coefficient tfcL was −66.9 ppm/° C.

Table 2 below summarizes the foregoing values of the plurality of temperature characteristics of the first comparative example.

TABLE 2

| Temperature range (° C.) | Temperature coefficient (ppm/° C.) First dielectric (∈r1 = 40) | Second dielectric (∈r2 = 7.43) | Dielectric resonator | Dielectric filter |
|---|---|---|---|---|
| 25 to 85 | (tf1H) −65 | (tf2H) −65 | (tf0H) −64.6 | (tfcH) −52.9 |
| −40 to 25 | (tf1L) −65 | (tf2L) −65 | (tf0L) −65.4 | (tfcL) −66.9 |

Figure 15:
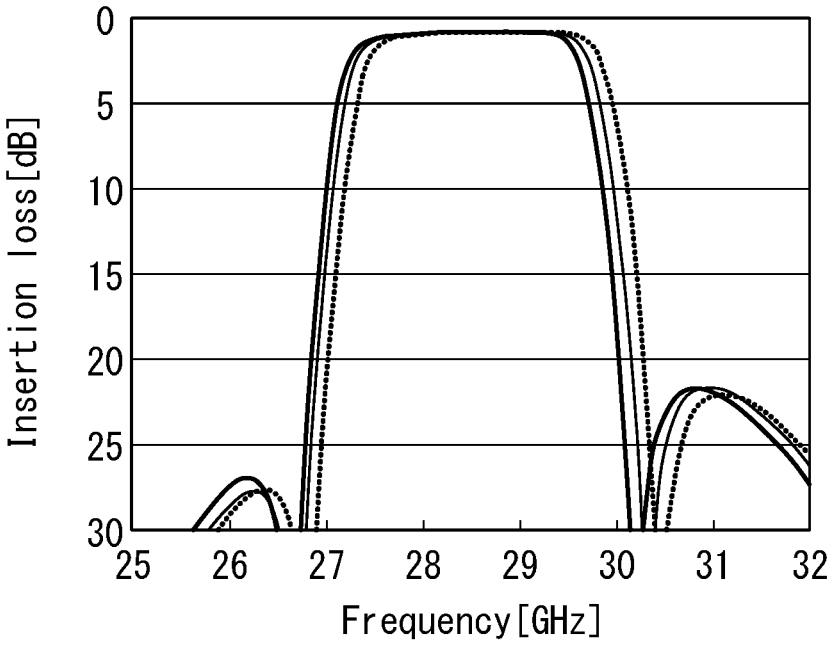
FIG. 15 RELATED ART
FIG. 15 is a characteristic diagram illustrating frequency responses of the insertion loss of a dielectric filter of a first comparative example.

FIG. 15 illustrates the frequency responses of the insertion loss of the dielectric filter of the first comparative example. In FIG. 15, the horizontal axis represents frequency, and the vertical axis represents insertion loss. In FIG. 15, the frequency responses at −40° C., 25° C., and 85° C. are represented by the dotted line, the thin solid line, and the thick solid line, respectively, as in FIG. 14.

In the second comparative example, the first relative permittivity εr1 of the first dielectric is 40, and the temperature coefficients tf1H and tf1L are both 120 ppm/° C. Further, in the second comparative example, the second relative permittivity εr2 of the second dielectric is 7.43, and the temperature coefficients tf2H and tf2L are both 120 ppm/° C. Thus, in the second comparative example, all the temperature coefficients tf1H, tf1L, tf2H and tf2L have a positive value, and are equal to the temperature coefficients tf1H and tf1L of the first example.

For the second comparative example, the temperature coefficient tf0H was 121.3 ppm/° C., the temperature coefficient tf0L was 118.6 ppm/° C., the temperature coefficient tfcH was 122.8 ppm/° C., and the temperature coefficient tfcL was 104.7 ppm/° C.

Table 3 below summarizes the foregoing values of the plurality of temperature characteristics of the second comparative example.

TABLE 3

| Temperature range (° C.) | Temperature coefficient (ppm/° C.) First dielectric (∈r1 = 40) | Second dielectric (∈r2 = 7.43) | Dielectric resonator | Dielectric filter |
|---|---|---|---|---|
| 25 to 85 | (tf1H) 120 | (tf2H) 120 | (tf0H) 121.3 | (tfcH) 122.8 |
| −40 to 25 | (tf1L) 120 | (tf2L) 120 | (tf0L) 118.6 | (tfcL) 104.7 |

For the first and second comparative examples, the values of the temperature coefficients tf0H and tfcH are close to those of the temperature coefficients tf1H and tf2H, and the values of the temperature coefficients tf0L and tfcL are close to those of the temperature coefficients tf1L and tf2L. Thus, for the first and second comparative examples, the absolute values of the temperature coefficients tf0H and tfcH are about as large as those of the temperature coefficients tf1H and tf2H, and the absolute values of the temperature coefficients tf0L and tfcL are about as large as those of the temperature coefficients tf1L an tf2L.

In contrast, for the first example, the absolute value of each of the temperature coefficients tf0H, tfcH, tf0L and tfcL is as small as 10 ppm/° C. or less. Such a simulation result also shows that the present embodiment enables the temperature coefficients tf0H, tfcH, tf0L and tfcL to be small in absolute value even if the absolute values of tf1H, tf2H, tf1L and tf2L are large.

Specific examples of a first dielectric material that can be used as the first dielectric and specific examples of a second dielectric material that can be used as the second dielectric will now be described. For example, the first dielectric contains a specific example of the first dielectric material as its main component. For example, the second dielectric contains a specific example of the second dielectric material as its main component. A main component refers to a component of 50 wt % or more.

Initially, specific examples of the first and second dielectric materials for a case where the temperature coefficient tf1H of the first dielectric has a positive value and the temperature coefficient tf2H of the second dielectric has a negative value will be described. In such a case, the temperature coefficient of resonant frequency of the first dielectric material has a positive value, and the temperature coefficient of resonant frequency of the second dielectric material has a negative value.

A specific example of the first dielectric material having a positive temperature coefficient of resonant frequency is a $BaO—Nd_2O_3—TiO_2$-based low-temperature co-fired ceramic. Such a material has a relative permittivity of 78.3 at 4.6 GHz, for example. The temperature coefficient of resonant frequency of the material at 25° C. to 85° C. is 40 ppm/° C., for example.

Another specific example of the first dielectric material having a positive temperature coefficient of resonant frequency is a $ZnO—TiO_2$-based low-temperature co-fired ceramic. Such a material has a relative permittivity of 38 at 6.9 GHz, for example. The temperature coefficient of resonant frequency of the material at 25° C. to 85° C. is 120 ppm/° C., for example.

A specific example of the second dielectric material having a negative temperature coefficient of resonant frequency is a low-temperature co-fired ceramic having a composition of $Mg_2SiO_4$. This material has a relative permittivity of 7.43 at 16 GHz, for example. The temperature coefficient of resonant frequency of the material at 25° C. to 85° C. is −68 ppm/° C., for example.

Next, specific examples of the first and second dielectric materials for a case where the temperature coefficient tf1H of the first dielectric has a negative value and the temperature coefficient tf2H of the second dielectric has a positive value will be described. In such a case, the temperature coefficient of resonant frequency of the first dielectric material has a negative value, and the temperature coefficient of resonant frequency of the second dielectric material has a positive value.

A specific example of the first dielectric material having a negative temperature coefficient of resonant frequency is a ceramic having a composition of $0.7(Na_{1/2}La_{1/2})TiO_3$-$0.3(Li_{1/2}Sm_{1/2})TiO_3$. This material has a relative permittivity of 117 at 3 GHz, for example. The temperature coefficient of resonant frequency of the material at 25° C. to 85° C. is −19 ppm/° C., for example.

A specific example of the second dielectric material having a positive temperature coefficient of resonant frequency is a material obtained by adding 4 wt % of $MgO—CaO—SiO_2—Al_2O_3$-based glass to a ceramic having a composition of $0.84Al_2O_3$-$0.16TiO_2$. Such a material has a relative permittivity of 9.4 at 11 to 13 GHz, for example. The temperature coefficient of resonant frequency of the material at 25° C. to 85° C. is approximately 10 ppm/° C., for example.

Other characteristics of the dielectric filter 1 according to the present embodiment will now be described. The dielectric filter 1 includes the four dielectric resonators 2A to 2D configured so that two dielectric resonators adjacent to each other in circuit configuration are magnetically coupled to each other, and the capacitor C10 for capacitively coupling the first input/output port 5A and the second input/output port 5B. The dielectric filter 1 of such a configuration is able to provide a first attenuation pole and a second attenuation pole in the frequency response of the insertion loss. The first attenuation pole occurs in a first passband-neighboring region, which is a frequency region close to the passband and lower than the passband. The second attenuation pole occurs in a second passband-neighboring region, which is a frequency region close to the passband and higher than the passband. Note that the number of the dielectric resonators required for providing the first and second attenuation poles is not limited to four but can be any even number.

The frequency response of the insertion loss of the dielectric filter 1 is adjustable by adjusting the phase change amounts to be obtained at the first and second phase shifters 11A and 11B. The phase change amounts at the first and second phase shifters 11A and 11B are changeable by changing the lengths of the first and second phase shifters 11A and 11B.

Second Embodiment

A second embodiment of the invention will now be described. The second embodiment differs from the first embodiment in the requirements for the first and second dielectrics.

In the present embodiment, the second relative permittivity εr2 of the second dielectric is higher than 1. Further, in the present embodiment, both of the temperature coefficient tf1H of resonant frequency of the first dielectric at 25° C. to 85° C. and the temperature coefficient tf2H of resonant frequency of the second dielectric at 25° C. to 85° C. are 33 ppm/° C. or less in absolute value. The positive and negative signs of the temperature coefficients tf1H and tf2H may be the same or different. The temperature coefficients tf1H and tf2H are preferably 10 ppm/° C. or less in absolute value.

The temperature coefficient tf0H of the resonant frequency f0 of the dielectric resonator 2 at 25° C. to 85° C. is preferably 33 ppm/° C. or less in absolute value. The reason therefor is as described in relation to the first embodiment. More preferably, the temperature coefficient tf0H is 10 ppm/° C. or less in absolute value.

In the present embodiment, the temperature coefficient tf1L of resonant frequency of the first dielectric at −40° C. to 25° C. and the temperature coefficient tf2L of resonant frequency of the second dielectric at −40° C. to 25° C. are preferably 30 ppm/° C. or less in absolute value. The positive and negative signs of the temperature coefficients tf1L and tf2L may be the same or different. More preferably, the temperature coefficients tf1L and tf2L are 10 ppm/° C. or less in absolute value.

The temperature coefficient tf0L of the resonant frequency f0 of the dielectric resonator 2 at −40° C. to 25° C. is preferably 30 ppm/° C. or less in absolute value. The reason therefor is as described in relation to the first embodiment. More preferably, the temperature coefficient tf0L is 10 ppm/° C. or less in absolute value.

In the present embodiment, both of the temperature coefficients tf1H and tf2H are 33 ppm/° C. or less in absolute value. This enables the temperature coefficients tf0H and tfcH to be as small as approximately 33 ppm/° C. or less in absolute value. When both of the temperature coefficients tf1H and tf2H are 10 ppm/° C. or less in absolute value, the temperature coefficients tf0H and tfcH can be as small as approximately 10 ppm/° C. or less in absolute value.

Further, in the present embodiment, when both of the temperature coefficients tf1L and tf2L are 30 ppm/° C. or less in absolute value, the temperature coefficients tf0L and tfcL can be as small as approximately 30 ppm/° C. or less in absolute value. When both of the temperature coefficients tf1L and tf2L are 10 ppm/° C. or less in absolute value, the temperature coefficients tf0L and tfcL can be as small as approximately 10 ppm/° C. or less in absolute value.

Now, a description will be given of dielectric filters of second and third examples and a dielectric filter of a third comparative example used in a simulation. Each of the dielectric filters of the second and third examples is an example of the dielectric filter 1 according to the present embodiment. The dielectric filter of the third comparative example is the same as the dielectric filters of the second and third examples except that the temperature coefficients tf1H, tf1L, tf2H and tf2L do not satisfy the requirements for the first and second dielectrics of the present embodiment.

In the second example, the first relative permittivity εr1 of the first dielectric is 40, and the temperature coefficients tf1H and tf1L are both −5 ppm/° C. Further, in the second example, the second relative permittivity εr2 of the second dielectric is 7.43, and the temperature coefficients tf2H and tf2L are both −5 ppm/° C.

For the second example, the temperature coefficient tf0H was −5.0 ppm/° C., the temperature coefficient tf0L was −5.0 ppm/° C., the temperature coefficient tfcH was −7.9 ppm/° C., and the temperature coefficient tfcL was −6.5 ppm/° C.

Table 4 below summarizes the foregoing values of the plurality of temperature characteristics of the second example.

TABLE 4

| | Temperature coefficient (ppm/° C.) | | | |
|---|---|---|---|---|
| Temperature range (° C.) | First dielectric (∈r1 = 40) | Second dielectric (∈r2 = 7.43) | Dielectric resonator | Dielectric filter |
| 25 to 85 | (tf1H) −5 | (tf2H) −5 | (tf0H) −5.0 | (tfcH) −7.9 |
| −40 to 25 | (tf1L) −5 | (tf2L) −5 | (tf0L) −5.0 | (tfcL) −6.5 |

Figure 16:
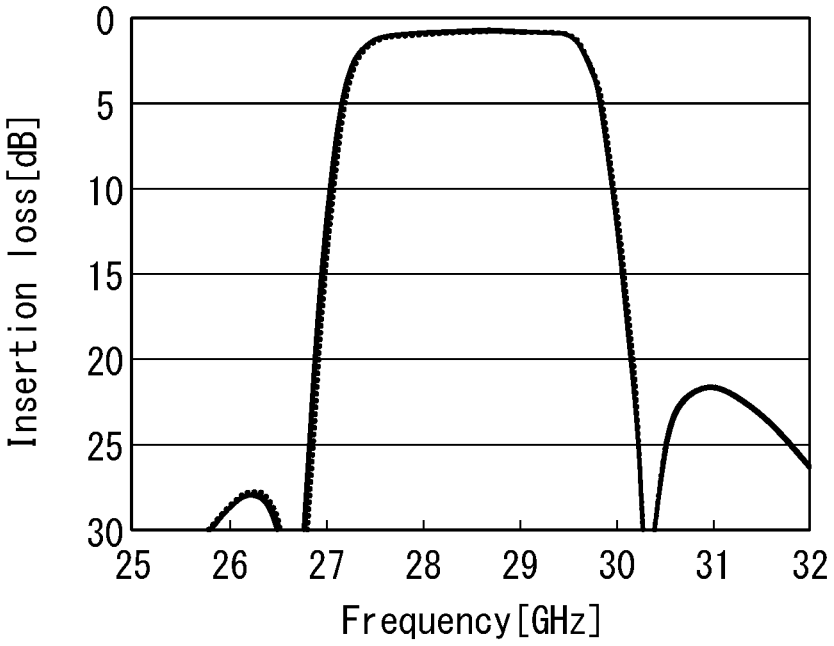
FIG. 16 is a characteristic diagram illustrating frequency responses of the insertion loss of a dielectric filter of a second example.

FIG. 16 illustrates the frequency responses of the insertion loss of the dielectric filter of the second example. In FIG. 16, the horizontal axis represents frequency, and the vertical axis represents insertion loss. In FIG. 16, the frequency responses at −40° C., 25° C., and 85° C. are represented by the dotted line, the thin solid line, and the thick solid line, respectively, as in FIG. 14. However, in FIG. 16 the three lines almost coincide with each other.

In the third example, the first relative permittivity εr1 of the first dielectric is 40, and the temperature coefficients tf1H and tf1L are both −30 ppm/° C. Further, in the third example, the second relative permittivity εr2 of the second dielectric is 7.43, and the temperature coefficients tf2H and tf2L are both −30 ppm/° C.

For the third example, the temperature coefficient tf0H was −29.8 ppm/° C., the temperature coefficient tf0L was −30.2 ppm/° C., the temperature coefficient tfcH was −31.0 ppm/° C., and the temperature coefficient tfcL was −26.2 ppm/° C.

Table 5 below summarizes the foregoing values of the plurality of temperature characteristics of the third example.

TABLE 5

| | Temperature coefficient (ppm/° C.) | | | |
|---|---|---|---|---|
| Temperature range (° C.) | First dielectric (∈r1 = 40) | Second dielectric (∈r2 = 7.43) | Dielectric resonator | Dielectric filter |
| 25 to 85 | (tf1H) −30 | (tf2H) −30 | (tf0H) −29.8 | (tfcH) −31.0 |
| −40 to 25 | (tf1L) −30 | (tf2L) −30 | (tf0L) −30.2 | (tfcL) −26.2 |

Figure 17:
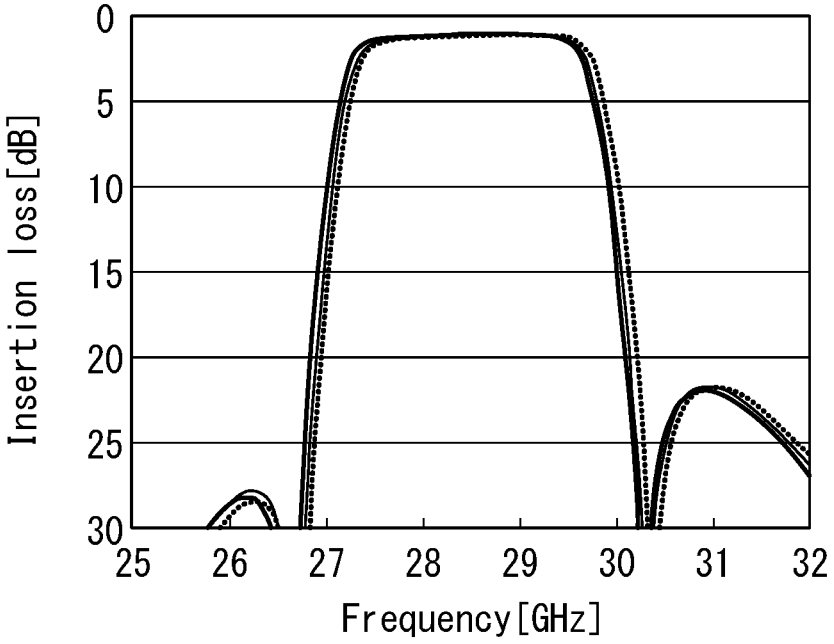
FIG. 17 is a characteristic diagram illustrating frequency responses of the insertion loss of a dielectric filter of a third example.

FIG. 17 illustrates the frequency responses of the insertion loss of the dielectric filter of the third example. In FIG. 17, the horizontal axis represents frequency, and the vertical axis represents insertion loss. In FIG. 17, the frequency responses at −40° C., 25° C., and 85° C. are represented by the dotted line, the thin solid line, and the thick solid line, respectively, as in FIG. 14.

In the third comparative example, the first relative permittivity εr1 of the first dielectric is 40, and the temperature coefficients tf1H and tf1L are both −5 ppm/° C. Further, in the third comparative example, the second relative permittivity εr2 of the second dielectric is 7.43, and the temperature coefficients tf2H and tf2L are both −65 ppm/° C.

For the third comparative example, the temperature coefficient tf0H was −42.6 ppm/° C., the temperature coefficient tf0L was −43.4 ppm/° C., the temperature coefficient tfcH was −38.3 ppm/° C., and the temperature coefficient tfcL was −47.2 ppm/° C.

Table 6 below summarizes the foregoing values of the plurality of temperature characteristics of the third comparative example.

TABLE 6

| | Temperature coefficient (ppm/° C.) | | | |
|---|---|---|---|---|
| Temperature range (° C.) | First dielectric (∈r1 = 40) | Second dielectric (∈r2 = 7.43) | Dielectric resonator | Dielectric filter |
| 25 to 85 | (tf1H) −5 | (tf2H) −65 | (tf0H) −42.6 | (tfcH) −38.3 |
| −40 to 25 | (tf1L) −5 | (tf2L) −65 | (tf0L) −43.4 | (tfcL) −47.2 |

Figure 18:
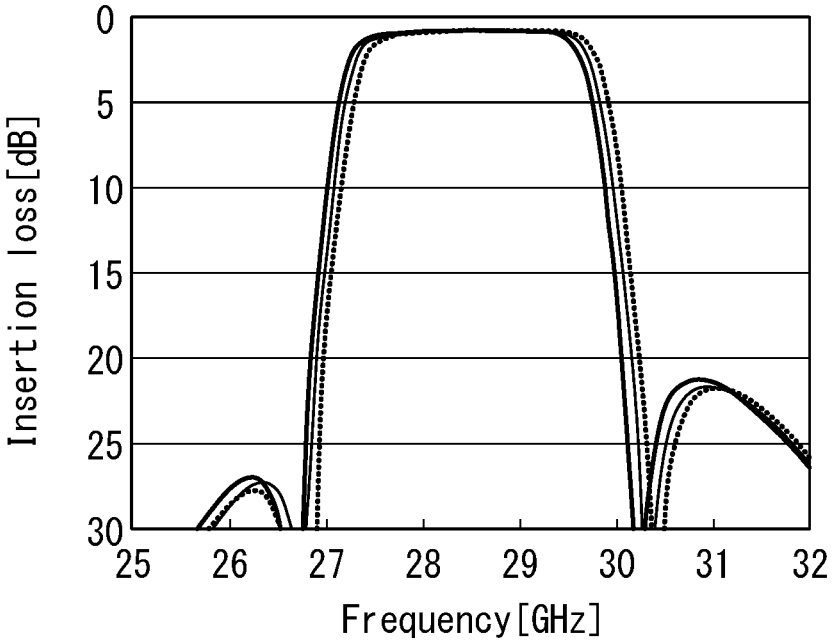
FIG. 18 RELATED ART
FIG. 18 is a characteristic diagram illustrating frequency responses of the insertion loss of a dielectric filter of a third comparative example.

FIG. 18 illustrates the frequency responses of the insertion loss of the dielectric filter of the third comparative example. In FIG. 18, the horizontal axis represents frequency, and the vertical axis represents insertion loss. In FIG. 18, the frequency responses at −40° C., 25° C., and 85° C. are represented by the dotted line, the thin solid line, and the thick solid line, respectively, as in FIG. 14.

From the third comparative example, it can be seen that if the temperature coefficients tf2H and tf2L of resonant frequency of the second dielectric are large in absolute value, the absolute values of the temperature coefficients tf0H, tfcH, tf0L and tfcL cannot be reduced by simply reducing the absolute values of the temperature coefficients tf1H and tf1L of resonant frequency of the first dielectric.

In contrast, according to the present embodiment, as also can be seen from the second and third examples, it is possible to reduce the absolute values of the temperature coefficients tf0H, tfcH, tf0L and tfcL by reducing both the absolute values of the temperature coefficients tf1H and tf1L of resonant frequency of the first dielectric and the absolute values of the temperature coefficients tf2H and tf2L of resonant frequency of the second dielectric.

Specific examples of a first dielectric material that can be used as the first dielectric and specific examples of a second dielectric material that can be used as the second dielectric will now be described. For example, the first dielectric contains a specific example of the first dielectric material as its main component. For example, the second dielectric contains a specific example of the second dielectric material as its main component.

A specific example of the first dielectric material is a ceramic having a composition of $Ba_{0.3}Sr_{0.7}(Zn_{1/3}Nb_{2/3})O_3$. This material has a relative permittivity of 40 at 10 GHz, for example. The temperature coefficient of resonant frequency of the material at 25° C. to 85° C. is approximately −5 ppm/° C., for example.

A specific example of the second dielectric material is a ceramic having a composition of $0.75MgAl_2O_4$-$0.25TiO_2$. This material has a relative permittivity of 10.7 at 7.5 GHz, for example. The temperature coefficient of resonant frequency of the material at 25° C. to 85° C. is approximately −12 ppm/° C., for example.

The configuration, operation and effects of the present embodiment are otherwise the same as those of the first embodiment.

The present invention is not limited to the foregoing embodiments, and various modifications may be made thereto. For example, the first dielectric material usable as the first dielectric and the second dielectric material usable as the second dielectric are not limited to those illustrated in the foregoing embodiments, and can be any dielectric materials that meet the requirements of the appended claims.

Obviously, many modifications and variations of the present invention are possible in the light of the above teachings. Thus, it is to be understood that, within the scope of the appended claims and equivalents thereof, the invention may be practiced in other embodiments than the foregoing most preferable embodiments.

What is claimed is:

1. A dielectric resonator comprising:

a resonator body portion formed of a first dielectric having a first relative permittivity;

a peripheral dielectric portion formed of a second dielectric and lying around the resonator body portion, the second dielectric having a second relative permittivity lower than the first relative permittivity; and a shield portion formed of a conductor, wherein the shield portion lies around the resonator body portion such that at least part of the peripheral dielectric portion is interposed between the shield portion and the resonator body portion, and either one of a temperature coefficient of resonant frequency of the first dielectric at 25° C. to 85° C. and a temperature coefficient of resonant frequency of the second dielectric at 25° C. to 85° C. has a positive value and the other has a negative value.

2. The dielectric resonator according to claim 1, wherein a temperature coefficient of resonant frequency of the dielectric resonator at 25° C. to 85° C. is lower in absolute value than the temperature coefficient of resonant frequency of the first dielectric at 25° C. to 85° C. and the temperature coefficient of resonant frequency of the second dielectric at 25° C. to 85° C.

3. The dielectric resonator according to claim 1, wherein a temperature coefficient of resonant frequency of the dielectric resonator at 25° C. to 85° C. is 33 ppm/° C. or less in absolute value.

4. The dielectric resonator according to claim 1, wherein a temperature coefficient of resonant frequency of the dielectric resonator at 25° C. to 85° C. is 10 ppm/° C. or less in absolute value.

5. The dielectric resonator according to claim 1, wherein the resonator body portion is in non-contact with the shield portion.

6. A dielectric filter comprising:

a plurality of dielectric resonators;

a plurality of resonator body portions each formed of a first dielectric and respectively corresponding to the plurality of dielectric resonators, the first dielectric having a first relative permittivity;

a peripheral dielectric portion formed of a second dielectric and lying around the plurality of resonator body portions, the second dielectric having a second relative permittivity lower than the first relative permittivity; and a shield portion formed of a conductor, wherein the shield portion lies around the plurality of resonator body portions such that at least part of the peripheral dielectric portion is interposed between the shield portion and the plurality of resonator body portions, each of the plurality of dielectric resonators is composed of a corresponding one of the plurality of resonator body portions, at least part of the peripheral dielectric portion, and the shield portion, and either one of a temperature coefficient of resonant frequency of the first dielectric at 25° C. to 85° C. and a temperature coefficient of resonant frequency of the second dielectric at 25° C. to 85° C. has a positive value and the other has a negative value.

7. The dielectric filter according to claim 6, wherein each of the plurality of resonator body portions is in non-contact with the shield portion.

8. A dielectric resonator comprising:

a resonator body portion formed of a first dielectric having a first relative permittivity;

a peripheral dielectric portion formed of a second dielectric and lying around the resonator body portion, the second dielectric having a second relative permittivity lower than the first relative permittivity and higher than 1; and a shield portion formed of a conductor, wherein the shield portion lies around the resonator body portion such that at least part of the peripheral dielectric portion is interposed between the shield portion and the resonator body portion, and both of a temperature coefficient of resonant frequency of the first dielectric at 25° C. to 85° C. and a temperature coefficient of resonant frequency of the second dielectric at 25° C. to 85° C. are 33 ppm/° C. or less in absolute value.

9. The dielectric resonator according to claim 8, wherein a temperature coefficient of resonant frequency of the dielectric resonator at 25° C. to 85° C. is 33 ppm/° C. or less in absolute value.

10. The dielectric resonator according to claim 8, wherein both of the temperature coefficient of resonant frequency of the first dielectric at 25° C. to 85° C. and the temperature coefficient of resonant frequency of the second dielectric at 25° C. to 85° C. are 10 ppm/° C. or less in absolute value.

11. The dielectric resonator according to claim 10, wherein a temperature coefficient of resonant frequency of the dielectric resonator at 25° C. to 85° C. is 10 ppm/° C. or less in absolute value.

12. The dielectric resonator according to claim 8, wherein the resonator body portion is in non-contact with the shield portion.

13. A dielectric filter comprising:

a plurality of dielectric resonators;

a plurality of resonator body portions each formed of a first dielectric and respectively corresponding to the plurality of dielectric resonators, the first dielectric having a first relative permittivity;

a peripheral dielectric portion formed of a second dielectric and lying around the plurality of resonator body portions, the second dielectric having a second relative permittivity lower than the first relative permittivity and higher than 1; and a shield portion formed of a conductor, wherein the shield portion lies around the plurality of resonator body portions such that at least part of the peripheral dielectric portion is interposed between the shield portion and the plurality of resonator body portions, each of the plurality of dielectric resonators is composed of a corresponding one of the plurality of resonator body portions, at least part of the peripheral dielectric portion, and the shield portion, and both of a temperature coefficient of resonant frequency of the first dielectric at 25° C. to 85° C. and a temperature coefficient of resonant frequency of the second dielectric at 25° C. to 85° C. are 33 ppm/° C. or less in absolute value.

14. The dielectric filter according to claim 13, wherein each of the plurality of resonator body portions is in non-contact with the shield portion.

* * * * *